US010571823B2

(12) United States Patent
Okubo et al.

(10) Patent No.: US 10,571,823 B2
(45) Date of Patent: Feb. 25, 2020

(54) IMAGE FORMING APPARATUS HAVING RECOVERY OF TONER BY DEVELOPING MEMBER, CONTROL OF CHARGING VOLTAGE AND CHARGING MEMBER CLEANING OPERATION

(71) Applicant: CANON KABUSHIKI KAISHA, Tokyo (JP)

(72) Inventors: Kazuhiro Okubo, Kawasaki (JP); Masanori Tanaka, Yokohama (JP); Takahiro Kawamoto, Yokohama (JP); Yuji Kawaguchi, Inagi (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/286,311

(22) Filed: Feb. 26, 2019

(65) Prior Publication Data

US 2019/0265625 A1 Aug. 29, 2019

(30) Foreign Application Priority Data

Feb. 28, 2018 (JP) ..... 2018-035521

(51) Int. Cl.
*G03G 15/02* (2006.01)
*G03G 21/00* (2006.01)

(52) U.S. Cl.
CPC ..... *G03G 15/0266* (2013.01); *G03G 15/0225* (2013.01); *G03G 15/0258* (2013.01); *G03G 21/0064* (2013.01)

(58) Field of Classification Search
CPC ..... G03G 15/0225; G03G 15/0258; G03G 15/0266; G03G 21/0064
(Continued)

(56) References Cited

U.S. PATENT DOCUMENTS

2007/0127944 A1* 6/2007 Mochizuki ..... G03G 15/161 399/101
2007/0160377 A1* 7/2007 Sakuwa ..... G03G 15/0266 399/50
(Continued)

FOREIGN PATENT DOCUMENTS

JP 2001-194951 A 7/2001
JP 2007-322634 A 12/2007
(Continued)

*Primary Examiner* — Robert B Beatty

(74) *Attorney, Agent, or Firm* — Canon U.S.A.Inc., IP Division

(57) ABSTRACT

In an image forming apparatus which includes a plurality of image forming units each including an image bearing member, a contact charging member, and a developer bearing member for forming toner of normal polarity, and which, in a printing operation, applies a charging bias having a first direction, in a cleaning operation, applies a charging bias having a second direction, and recovers residual toner remaining on the image bearing member which was not used for printing by the developer bearing member, before performing the cleaning operation, when successively performing the printing operation on a plurality of recording materials including a first recording material and a second recording material, which is used for printing following the first recording material, the charging voltage larger in absolute value in the printing operation for the second recording material than in the printing operation for the first recording material is applied.

20 Claims, 12 Drawing Sheets

(58) Field of Classification Search
USPC ..... 399/43, 50, 100, 149
See application file for complete search history.

(56) References Cited

U.S. PATENT DOCUMENTS

| | | | | |
|---|---|---|---|---|
| 2014/0064758 | A1* | 3/2014 | Kitajima | G03G 15/0283 399/50 |
| 2016/0238961 | A1* | 8/2016 | Takagami | G03G 15/0266 |
| 2016/0259283 | A1* | 9/2016 | Mimura | G03G 15/0266 |
| 2017/0097590 | A1* | 4/2017 | Kobayashi | G03G 15/161 |
| 2018/0149993 | A1* | 5/2018 | Tetsuno | G03G 15/0266 |
| 2018/0284637 | A1* | 10/2018 | Kuramoto | G03G 15/0266 |
| 2019/0286031 | A1* | 9/2019 | Mukai | G03G 15/161 |
| 2019/0302638 | A1* | 10/2019 | Tanaka | G03G 21/10 |

FOREIGN PATENT DOCUMENTS

| | | | | |
|---|---|---|---|---|
| JP | 2017040800 | A | * | 2/2017 |
| JP | 2017-142448 | A | | 8/2017 |

* cited by examiner

IMAGE FORMING APPARATUS HAVING RECOVERY OF TONER BY DEVELOPING MEMBER, CONTROL OF CHARGING VOLTAGE AND CHARGING MEMBER CLEANING OPERATION

BACKGROUND OF THE INVENTION

Field of the Invention

Aspects of the present disclosure generally relate to an image forming apparatus which forms an image on a recording material with use of an electrophotographic technique.

Description of the Related Art

An electrophotographic image forming apparatus, such as a copying machine or a laser beam printer, forms an electrostatic image (latent image), by radiating light corresponding to image data, on an electrophotographic photosensitive member (photosensitive drum) electrically charged by a charging unit in a uniform manner. Then, the electrophotographic image forming apparatus supplies, to the electrostatic image, toner of a developer serving as a recording agent from a developing device, thus making the latent image visible as a toner image. The electrophotographic image forming apparatus transfers, via a transfer device, the toner image from the photosensitive drum to a recording material such as recording paper. The electrophotographic image forming apparatus then fixes, via a fixing device, the toner image onto the recording material, thus forming a recording image.

Various proposed image forming apparatuses include a color image forming apparatus which includes a plurality of image forming units, causes the image forming units to form toner images of the respective different colors, and sequentially transfers the respective toner images to the same recording material in a superimposed manner, thus forming a color image.

Moreover, with regard to a charging system, from the viewpoint of advantages of, for example, low ozone and low power, a charging device of the contact system is frequently used, which electrically charges a photosensitive drum by bringing a charging member into contact with the photosensitive drum.

In recent years, to attempt minimization of an image forming apparatus, there has been proposed an image forming apparatus of the "cleanerless system", which includes neither a cleaning member which cleans a photosensitive drum nor a waste toner container portion. The cleanerless system is a system which causes a developing device to once again recover toner remaining on a photosensitive drum, thus requiring no waste toner container portion and enabling reuse of toner. When printing is performed with the cleanerless system, toner remaining on the photosensitive drum without being used for printing adheres to a charging member in part without being cleaned off. In an image forming apparatus using a plurality of photosensitive drums and developing devices of respective different colors, retransfer toner, which is re-transferred to a photosensitive drum at a transfer portion of a different color, is caused to be recovered by a charging member, so that the color mixture of toner is prevented or reduced. However, when a printing operation is continued without any change, toner may not be completely recovered by the charging member but instead may be recovered by a developing device of a different color, so that a color tone variation caused by color mixture may become an issue.

Therefore, Japanese Patent Application Laid-Open No. 2001-194951 discusses a cleaning method which transfers toner periodically recovered by a charging member from the charging member to a photosensitive drum, then moves the toner to an intermediate transfer member, and causes the toner to be discarded by an intermediate transfer member cleaner, thus preventing a color tone variation caused by color mixture.

SUMMARY OF THE INVENTION

In a color image forming apparatus using the cleanerless system, in view of user convenience, it is favorable that a cleaning operation for toner recovered by the charging member is performed as seldom as possible.

Aspects of the present disclosure are generally directed to reducing the number of times of cleaning of a charging member in a cleanerless system.

According to a first aspect of the present disclosure, an image forming apparatus includes a first image forming unit and a second image forming unit, which is located at a position different from that of the first image forming unit, each including an image bearing member, a charging member configured to perform contact charging on the image bearing member, and a developer bearing member configured to supply toner of normal polarity to the image bearing member so as to form a toner image on the image bearing member, a charging voltage application unit configured to apply a charging voltage to the charging member, and a control unit configured to control the charging voltage application unit, wherein the control unit performs a printing operation for printing the toner image on a recording material and a cleaning operation for cleaning the charging member at timing different from that of the printing operation and, when performing the printing operation, the control unit controls the charging voltage application unit to apply a charging voltage having a direction to cause toner opposite in polarity to the toner of normal polarity to move from the image bearing member to the charging member, wherein the first image forming unit and the second image forming unit are configured to cause residual toner remaining on a first image bearing member and a second image bearing member without being used for printing in the printing operation to be respectively recovered by a first developer bearing member and a second developer bearing member, and wherein, before performing the cleaning operation, when successively performing the printing operation on a plurality of recording materials including a first recording material and a second recording material, which is used for printing following the first recording material, the control unit controls the charging voltage application unit to apply the charging voltage larger in absolute value in the printing operation for the second recording material than in the printing operation for the first recording material.

Further features of the present disclosure will become apparent from the following description of exemplary embodiments with reference to the attached drawings.

DESCRIPTION OF THE EMBODIMENTS

Hereinafter, a developing device, a cartridge, and an image forming apparatus according to the present disclosure will be described in detail with reference to the drawings. However, for example, the dimensions, materials, shapes, and positional arrangements of constituent components described in the following exemplary embodiments can be changed or altered as appropriate according to the configuration of an apparatus to which the present disclosure is applied or various conditions. Accordingly, unless specifically stated otherwise, the scope of the present disclosure should not be construed to be limited to such configurations.

1. Image Forming Apparatus

Figure 1:
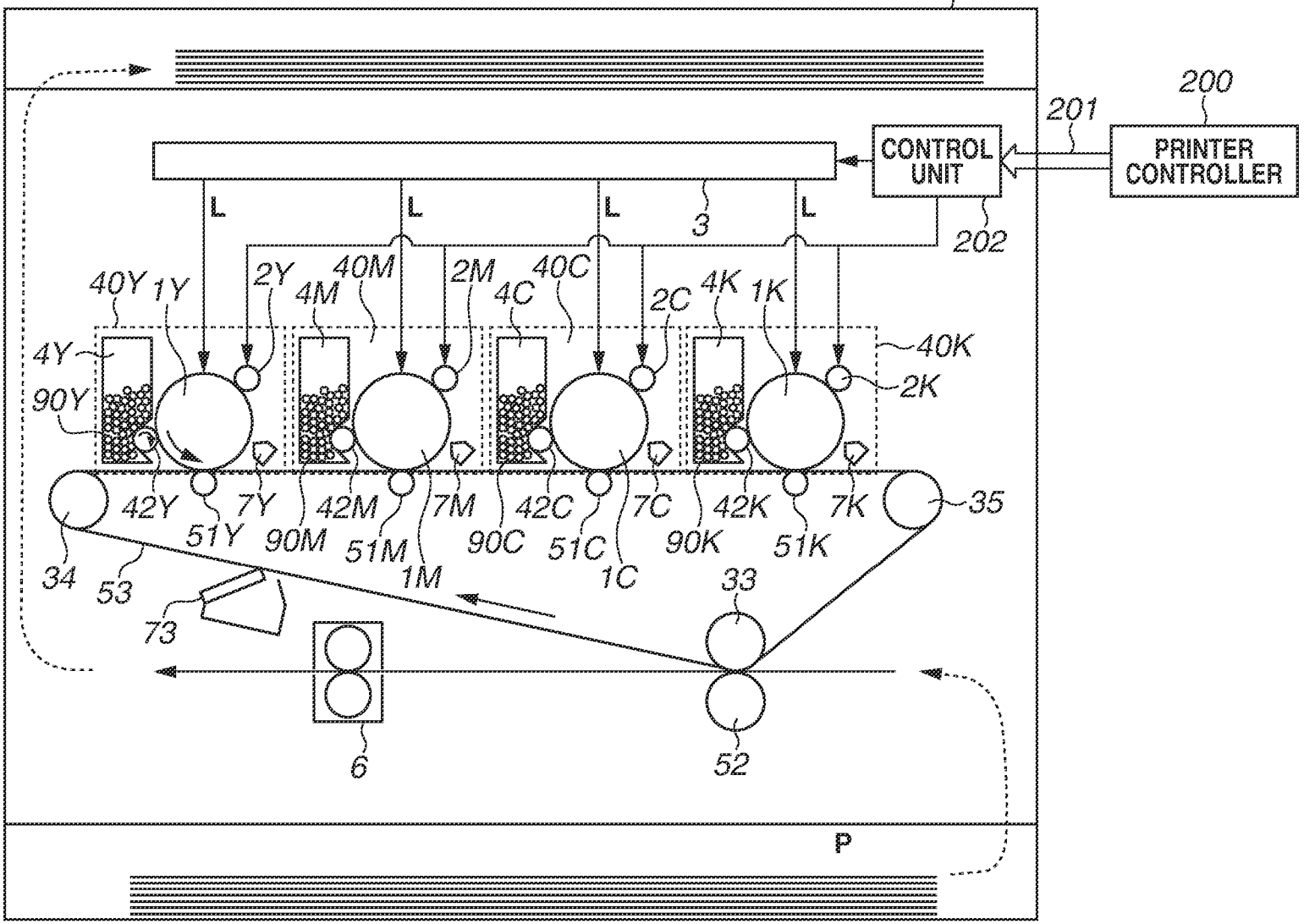
FIG. 1 is a schematic view of an image forming apparatus according to a first exemplary embodiment.

A first exemplary embodiment particularly relates to an image forming apparatus using the cleanerless system, which does not include a cleaning member serving as a cleaning unit for an image bearing member. FIG. 1 illustrates an example of the image forming apparatus 100. Referring to FIG. 1, image forming stations for four colors are arranged in the order of stations for respectively forming yellow, magenta, cyan, and black images from the left side of FIG. 1. Characters Y, M, C, and K appended to reference numerals in FIG. 1 indicate components of stations for respectively forming yellow, magenta, cyan, and black toner images on an image bearing member. A cylindrical photosensitive drum 1, which serves as an image bearing member, rotates around a shaft thereof. After the surface of the photosensitive drum 1 is uniformly charged by a charging roller 2, which is a contact charging device, a latent image is formed on the photosensitive drum 1 by an exposure device 3, which serves as an exposure unit. The charging roller 2 includes a metal core and a conductive elastic body layer formed concentrically and integrally around the metal core, and a charging bias is applied to the metal core by a charging bias (charging voltage) application unit (not illustrated). Toner 90, which serves as a one-component developer, is contained in a developing device 4, and the toner 90, which takes on a predetermined charge polarity, is supplied to an electrostatic latent image on the photosensitive drum 1 by a development roller 42, which serves as a developer bearing member, so that the electrostatic latent image is made visible as a toner image. The development roller 42 includes a metal core and a conductive elastic body layer formed concentrically and integrally around the metal core, and a developing bias is applied to the metal core by a developing bias (developing voltage) application unit (not illustrated). The toner image on the photosensitive drum 1 is electrostatically transferred onto an intermediate transfer member by a primary transfer roller 51, which serves as a transfer member, to which a transfer bias is applied by a transfer bias (transfer voltage) application unit (not illustrated). The primary transfer roller 51 is made in the form of a roller having a conductive elastic body layer formed around a shaft, and the transfer bias is applied to the shaft. Toner images of respective colors are sequentially transferred onto an intermediate transfer belt 53, which serves as the intermediate transfer member, so that a full-color toner image is formed thereon. After that, the full-color toner image is transferred to paper P, which serves as a recording material, by a secondary transfer unit 52, and is then fixed as a permanent image to the paper P with thermal melting and color mixture by a fixing unit 6, so that the paper P is discharged as an image-formed product.

In the image forming apparatus 100 according to the first exemplary embodiment, the exposure device 3 is provided, which exposes photosensitive drums 1Y, 1M, 1C, and 1K respectively arranged in process cartridges 40Y, 40M, 40C, and 40K. A time-series electrical digital pixel signal representing image information, which is input from a printer controller 200 to a control unit 202 via an interface 201 and is subjected to image processing, is input to the exposure device 3. The exposure device 3, which includes, for example, a laser output unit which outputs laser light modulated according to the input time-series electrical digital pixel signal, a rotary polygonal mirror (polygon mirror), an fθ lens, and a reflecting mirror, performs main scanning exposure on the surface of the photosensitive drum 1 with laser light L. This main scanning exposure and sub-scanning, which is performed by rotation of the photosensitive drum 1, function to form an electrostatic latent image corresponding to image information.

The intermediate transfer belt 53 is located in such a way as to be in contact with the photosensitive drums 1Y, 1M, 1C, and 1K, and has an electrical resistance value (volume resistivity) of $10^{11}$ Ω·cm to $10^{16}$ ω·cm. The intermediate transfer belt 53, which is 100 μm to 200 μm thick, is a resin film formed in an endless shape from, for example, polyvinylidene fluoride (PVDF), nylon, polyethylene terephthalate (PET), or polycarbonate (PC). Moreover, the intermediate transfer belt 53 is extended between a secondary transfer counter roller 33, a driving roller 34, and a tension roller 35, and is driven to circulate at a process speed by the driving roller 34 being rotated by a motor (not illustrated). The primary transfer roller 51 is made in the form of a roller having a conducive elastic layer around a shaft, and each primary transfer roller 51 is located almost in parallel with the photosensitive drum 1 and is kept in contact with the photosensitive drum 1 across the intermediate transfer belt 53 at a predetermined pressing force. A direct-current (DC)

voltage of positive polarity is applied to the shaft of the primary transfer roller 51, so that a transfer electric field is formed.

The secondary transfer roller 52 is located opposite to the secondary transfer counter roller 33 across the intermediate transfer belt 53 and is held with appropriate pressure applied thereto, so that a transfer electric field is formed by application of a DC voltage of positive polarity.

The fixing unit 6 is composed of a fixing roller, which is heated by a fixing heater, and a pressure roller, which is pressed against the fixing roller at a predetermined pressing force.

A belt cleaning member 73 is kept in contact with the intermediate transfer belt 53 at the downstream side in the rotational direction of the intermediate transfer belt 53 with respect to the secondary transfer position.

A paper feed unit includes a cassette, which stores sheets of paper P, and a pickup roller, which feeds sheets of paper P one by one from the cassette.

While a toner image formed on the photosensitive drum 1 is transferred to the intermediate transfer belt 53 by the primary transfer roller 51, a part of the toner image may remain as transfer residual toner on the photosensitive drum 1 without being transferred. The transfer residual toner remaining on the photosensitive drum 1 is toner taking on a normal polarity having a weak charge amount or inversion polarity toner taking on electric charge of reverse polarity. Moreover, toner transferred to the intermediate transfer belt 53 by the primary transfer roller 51 may also become inversion polarity toner taking on electric charge of reverse polarity by receiving discharge when passing through the primary transfer roller 51 of a station at the downstream side in the rotational direction of the intermediate transfer belt 53. The inversion polarity toner may electrically adhere to the photosensitive drum 1 of a station at the downstream side as retransfer toner. The transfer residual toner and the retransfer toner are described below in detail.

A pre-charging exposure device 7, which serves as a second exposure device, is provided at the downstream side of a contact portion between the photosensitive drum 1 and the primary transfer roller 51 and at the upstream side of a contact portion between the charging roller 2 and the photosensitive drum 1 with respect to the rotational direction of the photosensitive drum 1. To allow stabilized discharge to occur at a discharging portion, which is the contact portion between the charging roller 2 and the photosensitive drum 1, the pre-charging exposure device 7 optically eliminates electricity on the surface potential of the photosensitive drum 1 before entering the charging portion. As mentioned above, the transfer residual toner is mainly, for example, toner charged with positive polarity, which is opposite in polarity to the normal polarity with regard to the charging polarity, or toner charged with negative polarity, which is the normal polarity, but not having a sufficient electric charge. Eliminating electricity of the photosensitive drum 1 by the pre-charging exposure device 7 enables allowing homogeneous discharge to occur during charging processing and, at the same time, enables causing transfer residual toner to be uniformly charged with negative polarity.

Even during transfer at the secondary transfer roller 52 from the intermediate transfer belt 53 to a recording material, a part of the toner remains as secondary-transfer residual toner on the intermediate transfer belt 53 without being transferred. This secondary-transfer residual toner is removed from the intermediate transfer belt 53 by the belt cleaning member 73 and is then discarded into a waste toner container.

2. Cleanerless System

Figure 2A:
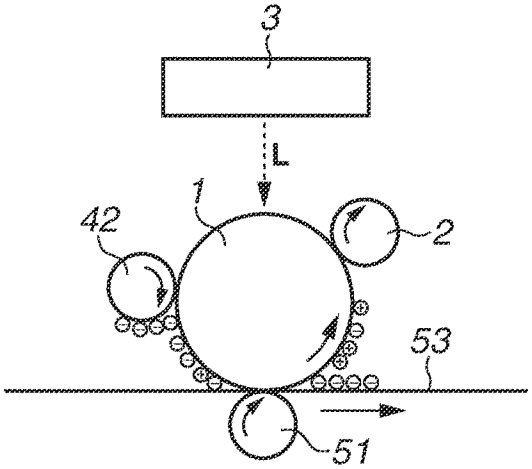
FIGS. 2A, 2B, 2C, 2D, and 2E are diagrams illustrating a method for recovering primary-transfer residual toner according to the first exemplary embodiment.
Figure 2B:
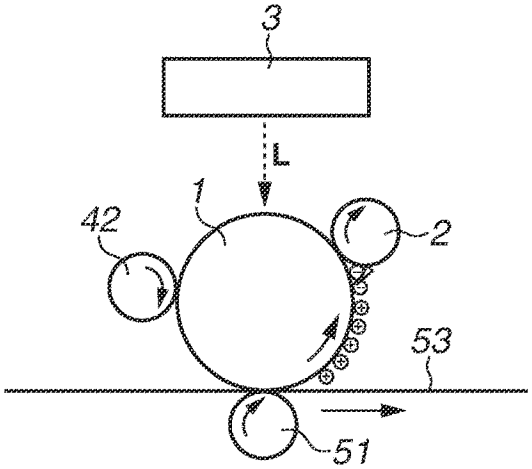
Figure 2C:
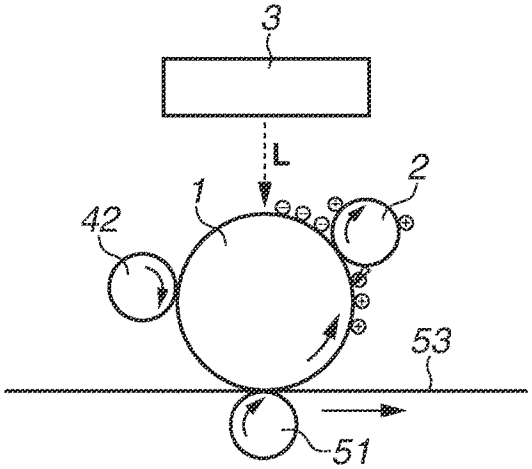

A phenomenon occurring in the operation of an individual process cartridge when the cleanerless system in the first exemplary embodiment is implemented is described with reference to FIGS. 2A, 2B, 2C, 2D, and 2E. As illustrated in FIG. 2A, after a toner image developed on the photosensitive drum 1 is primarily transferred onto the intermediate transfer belt 53, a part of the toner image, which has not been primarily transferred, remains as primary-transfer residual toner on the photosensitive drum 1. While, in a case where there is a cleaning member, the primary-transfer residual toner is recovered by the cleaning member, in the case of the cleanerless system, there is no cleaning device which recovers primary-transfer residual toner. Accordingly, toner on the photosensitive drum 1 directly enters the charging roller 2 without being cleaned off. The primary-transfer residual toner entering the charging roller 2 is normal polarity toner having a small charge amount or inversion polarity toner. As illustrated in FIG. 2B, such primary-transfer residual toner is subjected to discharge caused by an electric field generated by a charging bias at an air gap portion in front of the contact portion (charging nip) between the charging roller 2 and the photosensitive drum 1 and is thus charged with negative polarity, which is the normal polarity, being the same polarity as that of the photosensitive drum 1. The primary-transfer residual toner is small in charge amount and is, therefore, liable to be affected by discharge and likely to become toner of negative polarity, which is the normal polarity, due to discharge. Accordingly, since, at the charging nip, the charging bias becomes larger in minus than the surface potential of the photosensitive drum 1, as illustrated in FIG. 2C, the primary-transfer residual toner charged with negative polarity does not adhere to the charging roller 2 but passes through the charging roller 2. A part of the toner, i.e., inversion polarity toner having directly entered the charging roller 2 without being subjected to discharge is electrically attracted to the charging roller 2. Such inversion polarity toner is recovered as appropriate by the belt cleaning member 73 in a cleaning operation described below.

Figure 2D:
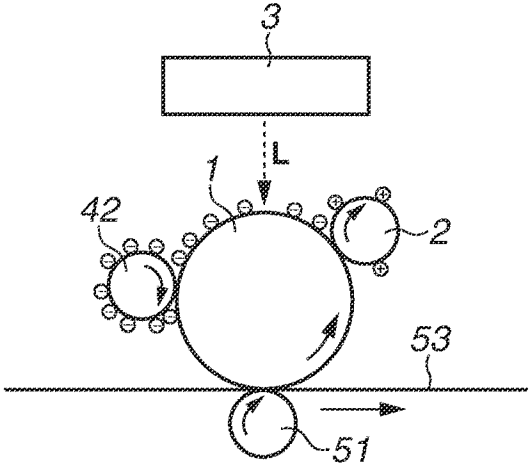
Figure 2E:
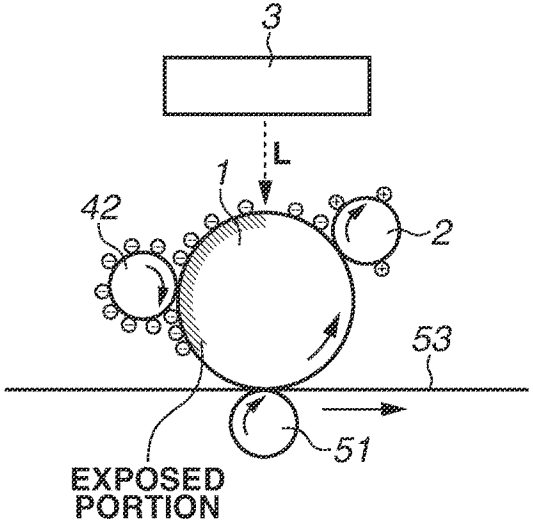

The primary-transfer residual toner having passed through the charging nip arrives at a laser irradiation position in association with the rotation of the photosensitive drum 1. The primary-transfer residual toner is not so large in amount as to block laser light emitted from the exposure device 3 and, therefore, has no effect on the process of forming an electrostatic latent image on the photosensitive drum 1 and then arrives at a contact portion (developing nip) between the development roller 42 and the photosensitive drum 1. As illustrated in FIG. 2D, toner at a non-exposed portion on the photosensitive drum 1 is electrically recovered toward the development roller 42 according to the potential relationship between the surface potential of the photosensitive drum 1 and the developing bias (the dark portion potential (Vd) of the photosensitive drum 1=−550 V and the developing bias=−400 V). In FIG. 2E, toner at an exposed portion on the photosensitive drum 1 remains on the photosensitive drum 1 without being recovered by the development roller 42 according to the potential relationship between the surface potential of the photosensitive drum 1 and the developing bias (the light portion potential (V1) of the photosensitive drum 1=−140 V and the developing bias=−400 V). However, toner 90 is also electrically supplied from the development roller 42 to the exposed portion on the photosensitive drum 1. Therefore, along with the toner 90 supplied from the development roller 42, the primary-transfer residual toner would also be retransferred. The developing bias in the first exemplary embodiment is expressed as a potential difference from the grounding potential. Accordingly, the developing bias=−400 V is interpreted as there being a potential difference of −400 V due to the developing bias applied to the metal core of the development roller 42 relative to the grounding potential (0 V). This also applies to a charging bias and a transfer bias, which are described below.

In this way, the primary-transfer residual toner remaining on the photosensitive drum 1 without being transferred to paper P is recovered by the developing device 4 at the non-exposed portion and is transferred together with the toner 90 newly used for developing from the photosensitive drum 1 at the exposed portion. The toner recovered by the developing device 4 is mixed with the toner 90 contained in the developing device 4 and is thus used. Accordingly, with regard to an individual cartridge, toner of the color of itself can be effectively used.

Next, a phenomenon occurring in a case where there is a plurality of process cartridges using the cleanerless system is described with reference to FIGS. 3A, 3B, 3C, and 3D. In the first exemplary embodiment, as illustrated in FIG. 1, four process cartridges are arranged in parallel, and consider a case where, for example, an image is printed with the cartridge 40Y, which is located at the most upstream side in the rotational direction of the intermediate transfer belt 53. Here, in describing the phenomenon, the process cartridge 40Y, which is located at the most upstream side, and the process cartridge 40M, which is located at the downstream side of the process cartridge 40Y, are assumed to be used. Even at the process cartridges 40C and 40K, which are located at the downstream side of the process cartridge 40M, a similar phenomenon to that occurring in the process cartridge 40M occurs, and, therefore, the description thereof is omitted.

Figure 3A:
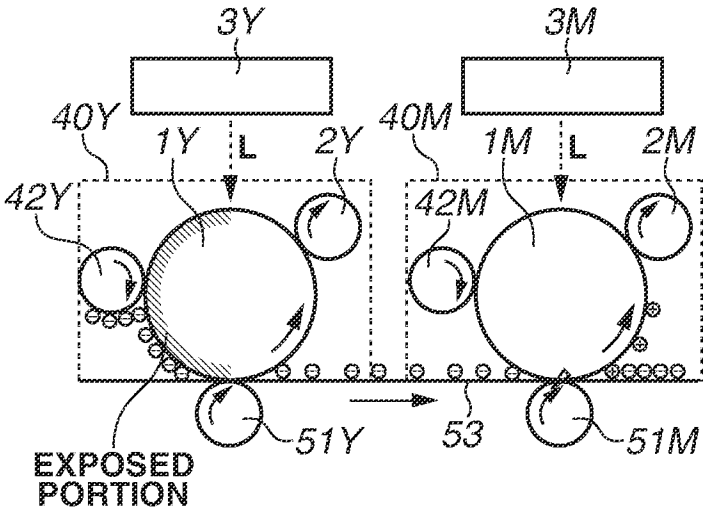
FIGS. 3A, 3B, 3C, and 3D are diagrams illustrating a method for recovering retransfer toner according to the first exemplary embodiment.

Yellow toner 90Y on the intermediate transfer belt 53 primarily transferred at the process cartridge 40Y located at the most upstream side passes through the primary transfer position (a contact portion between the photosensitive drum 1 and the primary transfer roller 51) of the cartridge 40M located at the downstream side. Before the yellow toner 90Y passes through the primary transfer position of the cartridge 40M, as illustrated in FIG. 3A, a part of the yellow toner 90Y on the intermediate transfer belt 53 inverts in polarity at the primary transfer position of the cartridge 40M due to discharge in the transfer nip. Then, the inversion polarity toner 90Y, inverted in polarity, would be retransferred onto the photosensitive drum 1M due to the potential difference between the photosensitive drum 1M and the primary transfer roller 51M. This phenomenon is referred to as "retransfer". In the cleanerless system, in which there is no cleaning member, the retransfer toner 90Y transferred to the photosensitive drum 1M directly enters the charging roller 2M.

Figure 3B:
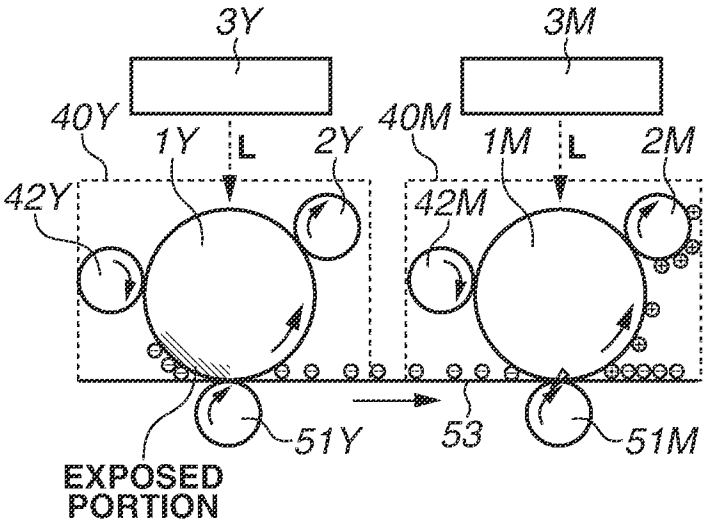

As with the above-mentioned primary-transfer residual toner, if the retransfer toner is allowed to pass through the charging roller 2 due to discharge, toner of a different color would enter the developing device 4. This causes toner of a cartridge for a different color other than the primary-transfer residual toner on the photosensitive drum 1 to be mixed in a different cartridge. If this retransferred toner is mixed with the toner 90 in the developing device 4, color mixture occurs, so that an original color tone may be impaired. Therefore, in the first exemplary embodiment, as illustrated in FIG. 3B, color mixture is prevented by causing the retransfer toner to be temporarily transferred to the charging roller 2M. Here, since the charge amount of retransfer toner is larger in inversion polarity than that of primary-transfer residual toner, the proportion of toner which becomes at the normal polarity due to discharge is small. As the influence of inversion caused by discharge is small, the retransfer toner is likely to be moved to the charging roller 2. Accordingly, the retransfer toner held by the charging roller 2 electrically adheres to the charging roller 2.

Figure 3C:
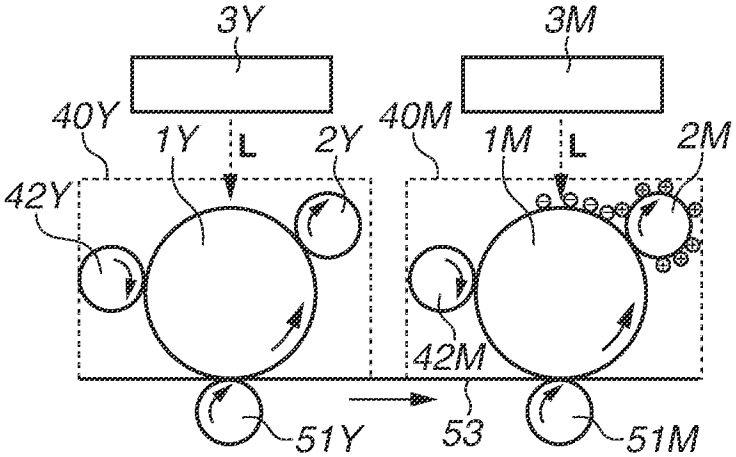
Figure 3D:
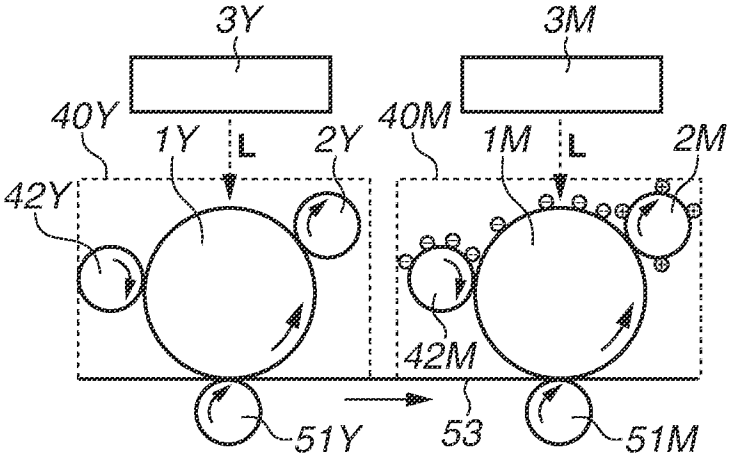

Since, during a printing operation, the charging bias applied to the charging roller 2M is a negative bias and the retransfer toner 90Y is at a positive polarity, as illustrated in FIG. 3B, the toner 90Y retransferred onto the photosensitive drum 1M is electrically attracted to the charging roller 2M. In this way, even in a case where full-color image printing is performed, retransfer toner of inversion polarity electrically adheres to the charging roller 2, so that color mixture can be prevented or reduced. However, as illustrated in FIG. 3C, the toner attracted to the charging roller 2M due to the potential difference is gradually subjected to injection of electric charge under the influence of a charging bias applied to the charging roller 2M, and thus transitions from the positive polarity to the negative polarity. When transitioning to the negative polarity, the retransfer toner becomes in such a relationship as to repel the charging bias applied to the charging roller 2M, and would be, therefore, gradually transferred onto the photosensitive drum 1M. Then, as a result, as illustrated in FIG. 3D, retransfer toner of a different color is recovered by the developing device 4 at the same time as image printing, so that this may bring about a color tone variation caused by color mixture. Moreover, if image printing is continued with toner kept adhering to the charging roller 2, retransfer toner being gradually accumulated may cause charging impediment. As a result, it becomes impossible to uniformly charge the surface of the photosensitive drum 1 at a desired potential, so that an image defect caused by charging failure may occur.

3. Charging Roller Cleaning

To prevent or reduce the above-mentioned image defect, it is necessary to once clean off toner attaching to the charging roller 2 at predetermined timing. Therefore, a cleaning operation is performed which cleans the charging roller 2 by returning toner recovered by the charging roller 2 to the photosensitive drum 1. The cleaning operation being performed causes the retransfer toner on the charging roller 2 to move from the photosensitive drum 1 onto the intermediate transfer belt 53 and causes the belt cleaning member 73 to recover such toner. This enables preventing or reducing charging failure while preventing color mixture. Timing at which to perform cleaning is described below.

Figure 4:
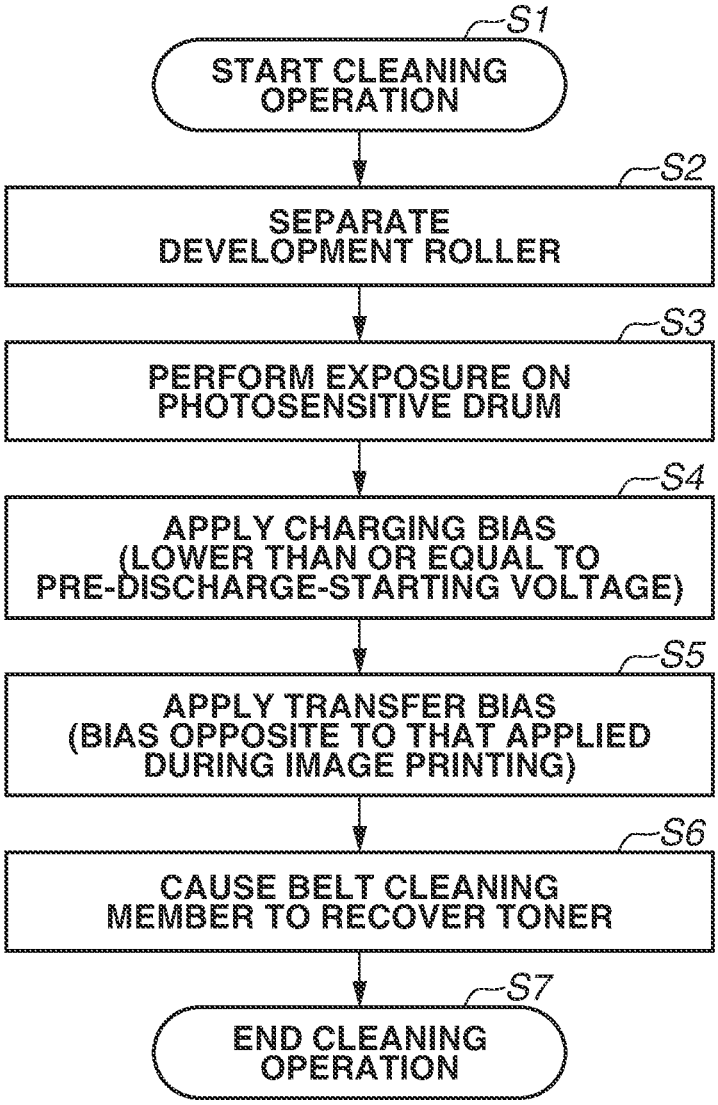
FIG. 4 is a flowchart illustrating the flow of a cleaning operation according to the first exemplary embodiment.

Details of the cleaning operation in the first exemplary embodiment are described with reference to the flowchart of FIG. 4.

In step S1, the image forming apparatus 100 switches to timing at which to perform cleaning, and, first, in step S2, the image forming apparatus 100 causes a development contact/separation cam serving as a contact/separation mechanism (not illustrated) to rotate so as to separate the development roller 42 from the photosensitive drum 1, thus starting preparing for the cleaning operation. First, in step S3, to remove electric charge on the surface of the photosensitive drum 1, the image forming apparatus 100 causes the exposure device 3 to perform exposure. After exposure on the photosensitive drum 1 is completed at a minimum as much as one rotation of the photosensitive drum 1, in step S4, the image forming apparatus 100 performs application of the charging bias. The charging bias to be applied at this time is set to be a bias lower than or equal to such a pre-discharge-starting voltage as not to cause discharge with the photosensitive drum 1. After the application of this charging bias is completed at a minimum as much as one rotation of the charging roller 2 and before the toner moved onto the photosensitive drum 1 arrives at a contact portion between the photosensitive drum 1 and the primary transfer roller 51, in step S5, the image forming apparatus 100 performs application of the transfer bias. The transfer bias to be applied at this time is set to be a transfer bias opposite in polarity to the transfer bias to be applied during image printing. This causes toner targeted for cleaning to move onto the intermediate transfer belt 53, so that, in step S6, the image forming apparatus 100 causes the belt cleaning member 73 to recover the toner and, in step S7, the image forming apparatus 100 ends the cleaning operation. The above-described series of operations enables cleaning off toner on the charging roller 2.

Figure 5A:
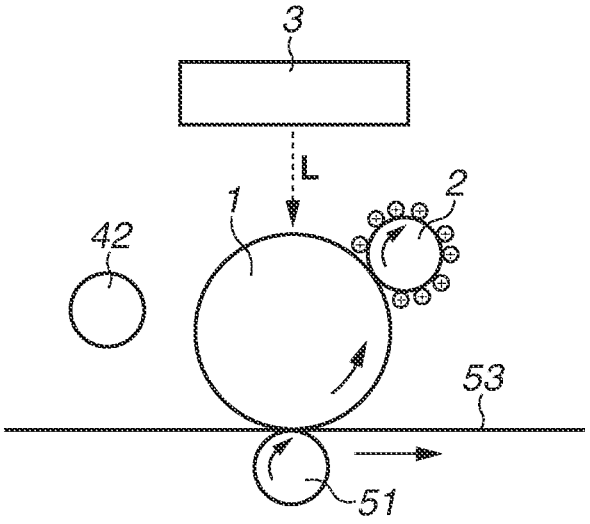
FIGS. 5A, 5B, and 5C are diagrams illustrating a charging roller cleaning method according to the first exemplary embodiment.
Figure 5B:
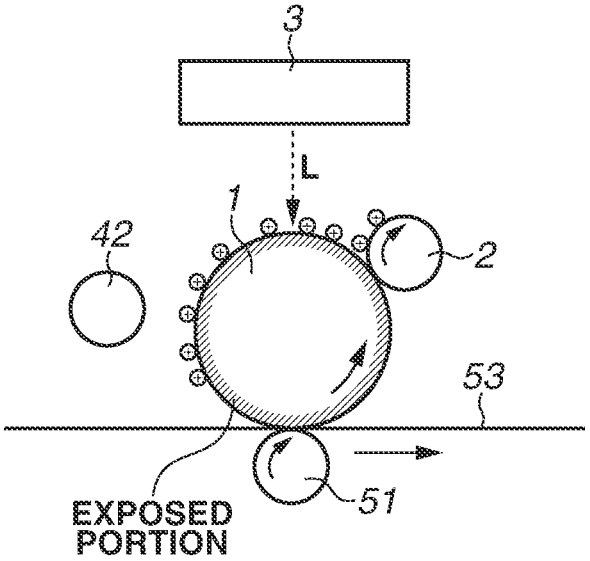
Figure 5C:
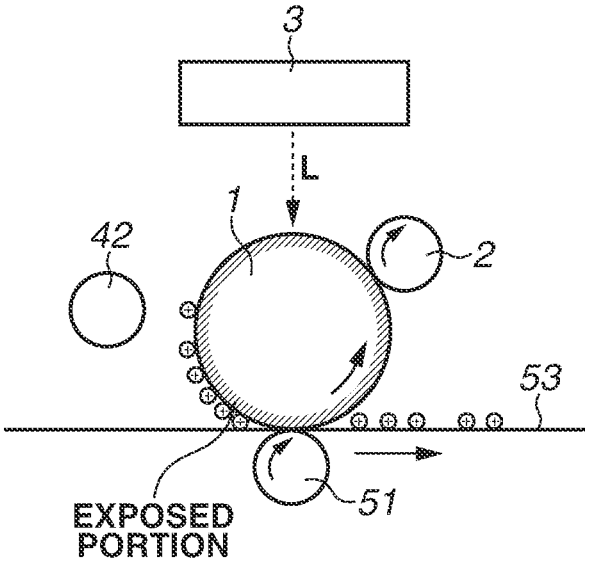

Next, the phenomenon is described in line with the flow of recovery of the toner 90 during the cleaning operation with reference to FIGS. 5A, 5B, and 5C.

First, after a toner image is formed on the intermediate transfer belt 53 and an image printing operation in which the recovery of the primary-transfer residual toner to the development roller 42 is completed is ended, as illustrated in FIG. 5A, the development roller 42 is separated from the photosensitive drum 1. This is performed to prevent the toner returned from the charging roller 2 to the photosensitive drum 1 from being recovered by the development roller 42. Next, as illustrated in FIG. 5B, to move the inversion polarity toner from the charging roller 2 onto the photosensitive drum 1, the charging bias is switched from −1100 V, which is to be applied during image printing, to +200 V, so that the retransfer toner on the charging roller 2 is transferred onto the photosensitive drum 1. Here, it is desirable that, before the charging bias is switched, the surface of the photosensitive drum 1 is exposed by the exposure device 3 in advance, so that the surface potential of the photosensitive drum 1 is set to about 0 V. Here, exposure on the photosensitive drum 1 can be performed by the pre-charging exposure device 7. As mentioned above, during discharge occurring between the charging roller 2 and the photosensitive drum 1, the toner on the photosensitive drum 1 becomes at the same polarity as that of the applied bias. However, since electric charges of the toner on the charging roller 2 move to the photosensitive drum 1 under the influence of discharge, the polarity of the toner adhering to the charging roller 2 becomes a polarity opposite to that of the applied bias. Accordingly, in a case where the surface potential of the photosensitive drum 1 is as high as the potential used during image printing, immediately after the charging bias is switched, back discharge occurs between the photosensitive drum 1 and the charging roller 2, so that the polarity of the toner on the charging roller 2 would become the normal polarity. Then, since the toner which has remained at the inversion polarity until then has changed to become at the normal polarity, the toner is not able to be transferred onto the photosensitive drum 1, so that it is impossible to perform an appropriate cleaning operation. Therefore, the surface potential of the photosensitive drum 1 is set to about 0 V in advance and the charging bias is set lower in absolute value than the pre-discharge-starting voltage, so that discharge does not occur, the change of the toner on the charging roller 2 to the normal polarity is prevented or reduced, and cleaning of the charging roller 2 becomes able to be efficiently performed. Furthermore, as long as such a potential relationship as not to bring about discharge is employed, the surface potential of the photosensitive drum 1 after being exposed is not limited to about 0 V. In the cleaning operation, at least the charging roller 2 is caused to rotate one turn or more, so that the entire circumference of the charging roller 2 is cleaned. Next, switching of the transfer bias, which is applied to the primary transfer roller 51, is performed. As illustrated in FIG. 5C, the transfer bias is switched from +500 V, which is applied during image printing, to −200 V, which is a transfer bias used during cleaning. This switching enables electrically moving the toner charged at the inversion polarity on the photosensitive drum 1 onto the intermediate transfer belt 53. After that, the toner on the intermediate transfer belt 53 is recovered by the belt cleaning member 73 into a waste toner container. In this way, performing cleaning of the charging roller 2 while separating the development roller 42 from the photosensitive drum 1 enables preventing color mixture caused by recovery of toner into the developing device 4 and thus enables performing appropriate cleaning by the belt cleaning member 73 recovering the toner as waste toner.

According to the above-described cleaning operation, the inversion polarity toner adhering to the charging roller 2 is transferred onto the photosensitive drum 1 due to the potential difference between the photosensitive drum 1 and the charging roller 2, is then transferred to the intermediate transfer belt 53, and is thus recovered by the belt cleaning member 73 on the intermediate transfer belt 53.

The above-described cleaning operation only needs to be performed in a case where retransfer toner of the inversion polarity electrically adheres to the charging roller 2 and the toner is recovered by the belt cleaning member 73. Accordingly, the above-described cleaning operation does not need to be performed by the process cartridge 40 located at the most upstream side of the intermediate transfer belt 53. Since the belt cleaning member 73 is located at the upstream side of the process cartridge 40 located at the most upstream side of the intermediate transfer belt 53, the secondary-transfer residual toner is able to be recovered. Moreover, at the process cartridge 40 located at the most upstream side of the intermediate transfer belt 53, originally, retransfer does not occur. Accordingly, since, at the process cartridge 40 located at the most upstream side of the intermediate transfer belt 53, toner of a different color does not intervene, there is no occurrence of a color tone variation caused by color mixture.

Moreover, the charging bias, the transfer bias, and the execution time concerning cleaning in the first exemplary embodiment are not necessarily limited to the above-mentioned ones.

Next, cleaning operation execution timing in the printing operation is described.

In the first exemplary embodiment, the cleaning operation is performed at the time of ending of the printing operation, and cleaning off toner on the charging roller 2 each time printing is ended enables continuing printing without lowering the image quality performance. Performing the cleaning operation after printing is ended is also desirable from the viewpoint that the cleaning operation is able to be performed without a downtime during printing being increased.

On the other hand, in a case where successively transmitted jobs are received, during image printing, until the cleaning operation, which is performed after ending of printing, is performed, inversion polarity toner continues being recovered by the charging roller 2 without toner being transferred from the charging roller 2 to the photosensitive drum 1. When image printing is successively performed, it is desirable that the cleaning operation not be performed as much as possible to reduce a downtime. For that purpose, during image printing, it is necessary to continue holding inversion polarity toner on the charging roller 2. However, since, during continuous printing, inversion polarity toner continues adhering to the charging roller 2 during each printing operation, the charge decay of toner or the amount of adhered toner becomes large, so that it may be impossible to cause toner to continue adhering to the charging roller 2 and, thus, it may be impossible to perform appropriate image printing.

Therefore, in a case where the number of sheets of a recording material to be continuously printed is large, a threshold value may be provided and the cleaning operation may be introduced during the midstream of continuous printing. Accordingly, the cleaning operation is not performed only after the printing operation is ended, but the cleaning operation is introduced during the midstream of continuous printing, so that the occurrence of an image defect is prevented or reduced. However, from the viewpoint of reduction of a downtime, it is favorable that the cleaning operation is not introduced during continuous printing as much as possible.

Figure 6:
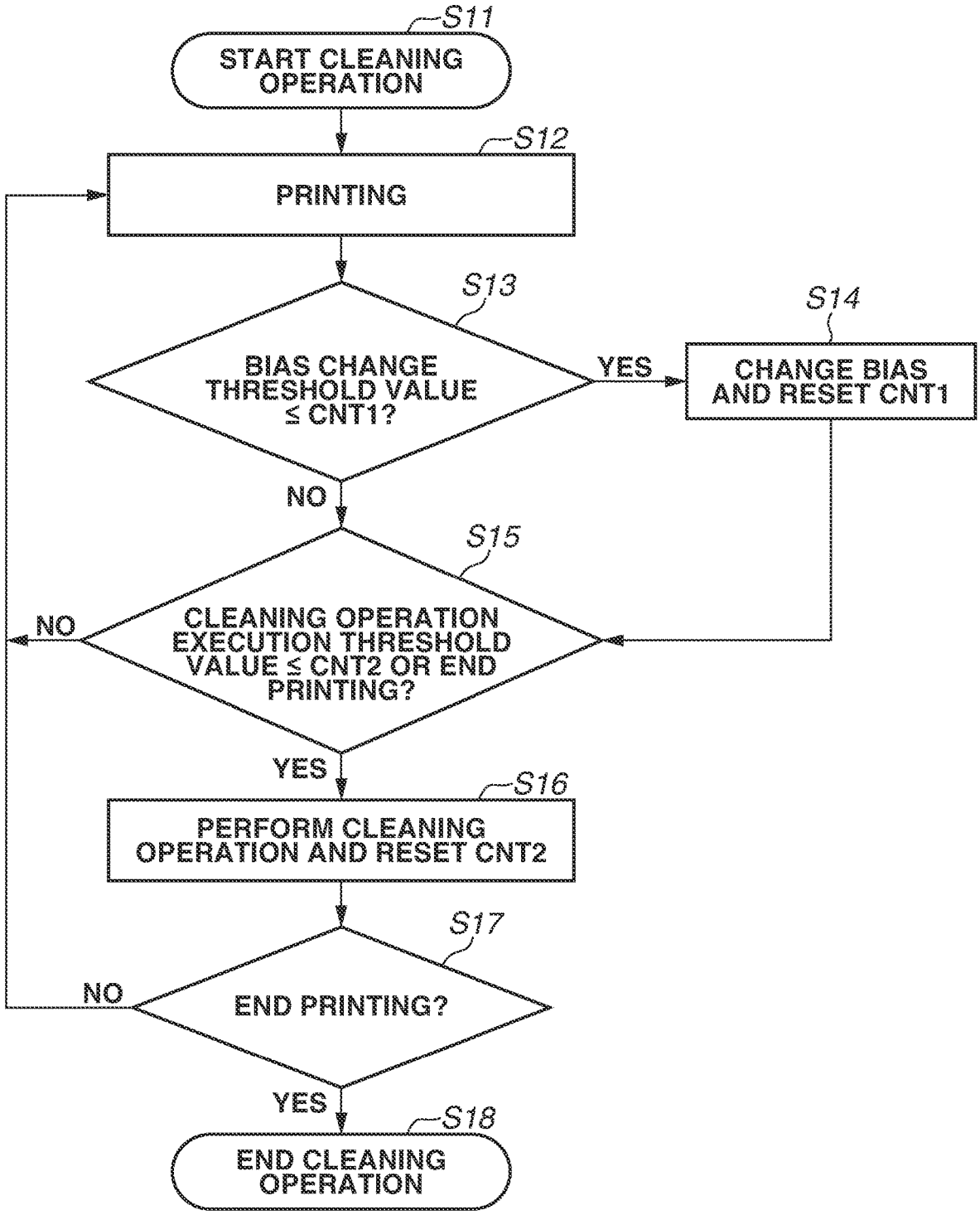
FIG. 6 is a flowchart illustrating the flow of a printing operation and a cleaning operation according to the first exemplary embodiment.

FIG. 6 illustrates a sequence chart of cleaning operation execution timing at the time of execution of the printing operation in the first exemplary embodiment. The cleaning operation execution timing is described in sequence with reference to FIG. 6.

In step S11, the image forming apparatus 100 starts driving of a motor (not illustrated) for an image printing operation, and, in step S12, the image forming apparatus 100 applies various biases to start the image printing operation. During the printing operation, the image forming apparatus 100 performs counting of a bias change counter (CNT1) and a cleaning operation execution counter (CNT2). In the first exemplary embodiment, when the bias change counter (CNT1) reaches a threshold value, the image forming apparatus 100 changes the charging bias and the developing bias and counts the number of printed sheets. During the printing operation, in step S13, the image forming apparatus 100 checks whether the bias change counter (CNT1) has reached a bias change threshold value, and, if it is determined that the bias change counter (CNT1) has reached the bias change threshold value (YES in step S13), then in step S14, the image forming apparatus 100 changes each bias which is applied during the printing operation and resets the bias change counter (CNT1). Similarly, in step S15, the image forming apparatus 100 checks whether the cleaning operation execution counter (CNT2) has reached a cleaning operation execution threshold value or whether to end the printing operation. If it is determined that the cleaning operation execution counter (CNT2) has reached the cleaning operation execution threshold value or it is determined to end the printing operation (YES in step S15), then in step S16, the image forming apparatus 100 ends the printing operation, performs the cleaning operation, and resets the cleaning operation execution counter (CNT2). After that, if the printing operation is ended (YES in step S17), then in step S18, the image forming apparatus 100 stops driving of the motor and ends the cleaning operation. On the other hand, if the printing operation is continued (NO in step S17), the processing returns to step S12, in which the image forming apparatus 100 continues printing.

Furthermore, as described below, any one of parameters which affect toner on the charging roller 2, such as the amount of exposure by the exposure device 3, the transfer bias, and the pre-charging exposure amount, can be changed based on the bias change threshold value. Here, it is desirable that the cleaning operation execution determination be performed according to the degree of adhering of toner to the charging roller 2. Accordingly, the thing to be counted does not need to be the number of printed sheets, but can be, for example, a thing associated with the degree of adhering of toner to the charging roller 2, such as the number of rotations or the rotation time of the photosensitive drum 1 or the printing rate of toner. The degree of adhering of toner to the charging roller 2 is previously obtained by experiments and is estimated based on the usage environment or the usage condition of the developing device 4. This is because the adherence of toner to the charging roller 2 is mostly dependent on the amount of retransfer toner and the amount of retransfer toner is based on the usage environment or the usage condition of the developing device 4. For example, when the remaining amount of toner in the developing device 4 is small and the degradation of toner is accelerated, since the amount of retransfer toner becomes large, the number of printed sheets based on which to start the cleaning operation is controlled to be a smaller number.

4. Charging Bias Control

Therefore, in the first exemplary embodiment, to prompt discharge during continuous printing, the charging bias is controlled for every number of continuously printed sheets. Specifically, at the initial stage of continuous printing, since the polarity of toner on the charging roller 2 is kept to be an inversion polarity and the amount of inversion polarity toner on the charging roller 2 is small, so large discharge is not required. On the other hand, at the middle stage to the later stage of continuous printing, since the charge decay of inversion polarity toner on the charging roller 2 is accelerated and the amount of inversion polarity toner increases, such a charging bias as to prompt discharge is set.

Bias control performed during an image printing operation at the time of continuous printing and a relationship between toner retention and color mixture on the charging roller 2 are described below.

A study was made on an image defect occurring when continuous printing was performed until the cleaning operation was performed in a state in which inversion polarity toner was retained on the charging roller 2. Specifically, when continuous printing on 100 sheets of an image with a printing rate of 5% using the yellow cartridge 40Y was performed 200 times, the level of color mixture with the cyan cartridge 40C and the level of an image defect (vertical streaks caused by drum abrasion or a reduction in density) caused by discharge were evaluated with respect to images. With regard to the level of color mixture, "○" indicates a problem-free level as a viewable image, and "x" indicates a level at which the change of color tone is not permissible. With regard to the level of an image defect caused by discharge, "○" indicates a problem-free level as a viewable image, and "x" indicates a level at which the image defect is not permissible. In the first exemplary embodiment, a case where yellow toner 90Y was mixed with cyan toner 90C in color as a combination in which the change of color tone was conspicuous was employed for the study.

In a comparative example 1, as a charging bias during image printing, −1100 V is applied to the charging roller 2, and the surface potential of the photosensitive drum 1 immediately after being discharged is adjusted to about −550 V. Moreover, as a developing bias, −400 V is applied to the development roller 42, and, as a transfer bias, +500 V is applied to the primary transfer roller 51. The potential of an image portion on the photosensitive drum 1 is kept at about −140 V under the control of the exposure device 3. The surface of the photosensitive drum 1 having passed through a contact portion with the primary transfer roller 51 is subjected to pre-charging exposure performed by the pre-charging exposure device 7, so that the surface potential of the photosensitive drum 1 is once set to about 0 V. During continuous image printing, in which successively transmitted jobs are received, a printing operation is continued with these biases maintained. When a continuous image printing operation for 100 sheets is completed, the cleaning operation is performed. Such a series of operations is repeated 200 times.

The results of the comparative example 1 are described with use of Table 1. Table 1 represents the levels of color mixture and an image defect caused by discharge in the comparative example 1 obtained when continuous printing was performed while the relationship of biases during continuous printing was maintained. The results shown in Table 1 indicate that, under the conditions employed in the comparative example 1, color mixture occurs and an image defect caused by discharge does not occur. The cause of occurrence of color mixture in the comparative example 1 includes a phenomenon in which, since continuous printing is performed under the condition that the potential difference between the charging bias and the surface potential of the photosensitive drum 1 is unvarying, as the number of printed sheets is larger, it becomes electrically difficult to retain inversion polarity toner on the charging roller 2. It can be considered that yellow toner 90Y of the inversion polarity recovered to the charging roller 2C of the cyan cartridge 40C during continuous printing is changed to have the normal polarity due to the influence of charging, is retransferred onto the photosensitive drum 1, and is then recovered by the developing device 4C for cyan, thus leading to the occurrence of color mixture.

In a comparative example 2, to prevent or reduce color mixture, the amount of discharge between the charging roller 2 and the photosensitive drum 1 was increased. In order not to invert the polarity of toner on the charging roller 2, it is necessary to prompt discharge between the photosensitive drum 1 and the charging roller 2, thus actively causing discharge to occur between the photosensitive drum 1 and the charging roller 2. Then, electric charges injected into toner on the charging roller 2 move onto the photosensitive drum 1, so that, as a result, the positive polarity of recovered toner on the charging roller 2 increases. Since, as discharge is larger, the movement of electric charges is accelerated, the positive polarity of toner on the charging roller 2 is retained. Since the amount of electric charge which moves from toner on the charging roller 2 to the photosensitive drum 1 varies according to the strength or weakness of discharge, the potential difference between the charging bias and the surface potential of the photosensitive drum 1, which governs the strength or weakness of discharge, has an effect on the polarity of toner on the charging roller 2. While, when the potential difference is made larger, discharge is prompted and the polarity of toner is kept to be the positive polarity, if the potential difference is small, the amount of discharge is small and electric charges are injected into toner due to the influence of the charging bias, so that the positive polarity cannot be maintained. Accordingly, in order to retain inversion polarity toner on the charging roller 2, it is desirable to make the potential difference between the surface potentials of the charging roller 2 and the photosensitive drum 1 larger.

In conditions employed in the comparative example 2, during continuous printing, −1190 V, which is a charging bias always higher than that in the comparative example 1, is applied to the charging roller 2. Accordingly, the surface of the photosensitive drum 1 is charged at about −640 V. Moreover, the surface potential of the photosensitive drum 1 after being subjected to primary transfer is adjusted to about 0 V with pre-charging exposure performed by the pre-charging exposure device 7 in such a way as to become the same as that in the comparative example 1. In other words, the amount of discharge occurring between the charging roller 2 and the photosensitive drum 1 is set larger than that in the comparative example 1. Moreover, transfer residual toner and retransfer toner are also adjusted to predetermined amounts as appropriate. The developing bias is adjusted to −490 V in conformity with the surface potential of the photosensitive drum 1 and is thus applied to the development roller 42. With this, the potential of an image portion on the photosensitive drum 1 is kept to be about −230 V under the control of the exposure device 3.

In table 1, the results of the comparative example 2 are described while being compared with those of the comparative example 1. Under the conditions employed in the comparative example 2, color mixture did not occur and an improvement tendency was shown compared to the comparative example 1, but an image defect caused by discharge occurred. As a cause for such results, it can be considered that, while, along with an increase of the charging bias, the amount of discharge increases and the level of color mixture is improved, the influence of discharge brings about an image defect. In order to maintain the ability of retaining toner on the charging roller 2, electric charges of toner on the charging roller 2 have to be maintained, so that it becomes necessary to prompt discharge between the charging roller 2 and the photosensitive drum 1. However, increasing the charging bias caused damage due to the influence of discharge to the photosensitive drum 1. It can be said that making the potential difference larger so as to enlarge discharge brought about vertical streaks caused by abrasion of the photosensitive drum 1 due to the influence of discharge or a reduction in density caused by discharge degradation of the photosensitive drum 1.

Figure 7:
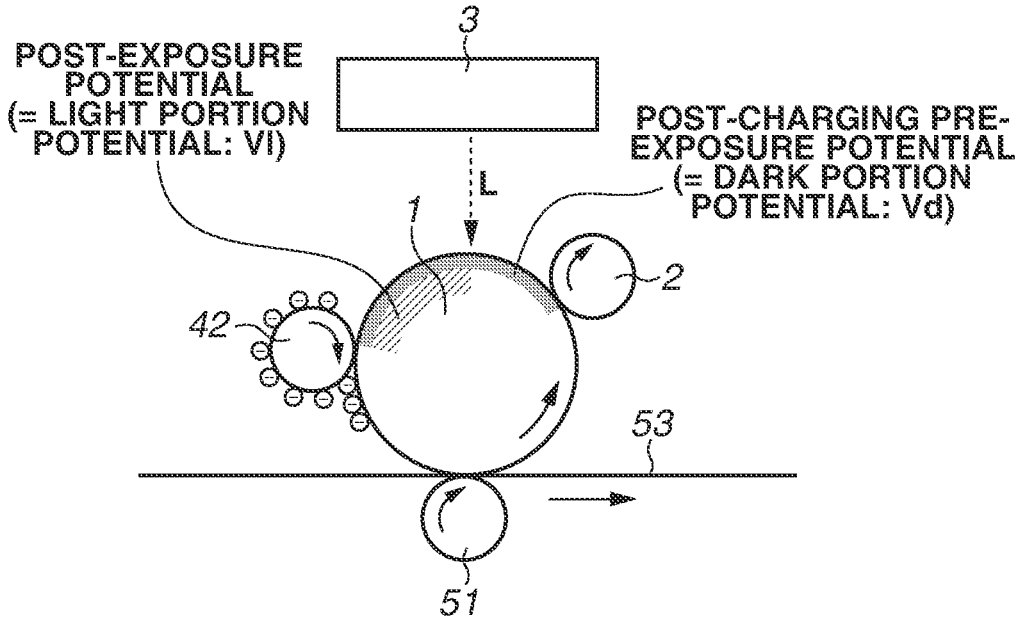
FIG. 7 is a diagram illustrating a positional relationship between electric potentials according to the first exemplary embodiment.
Figure 8:
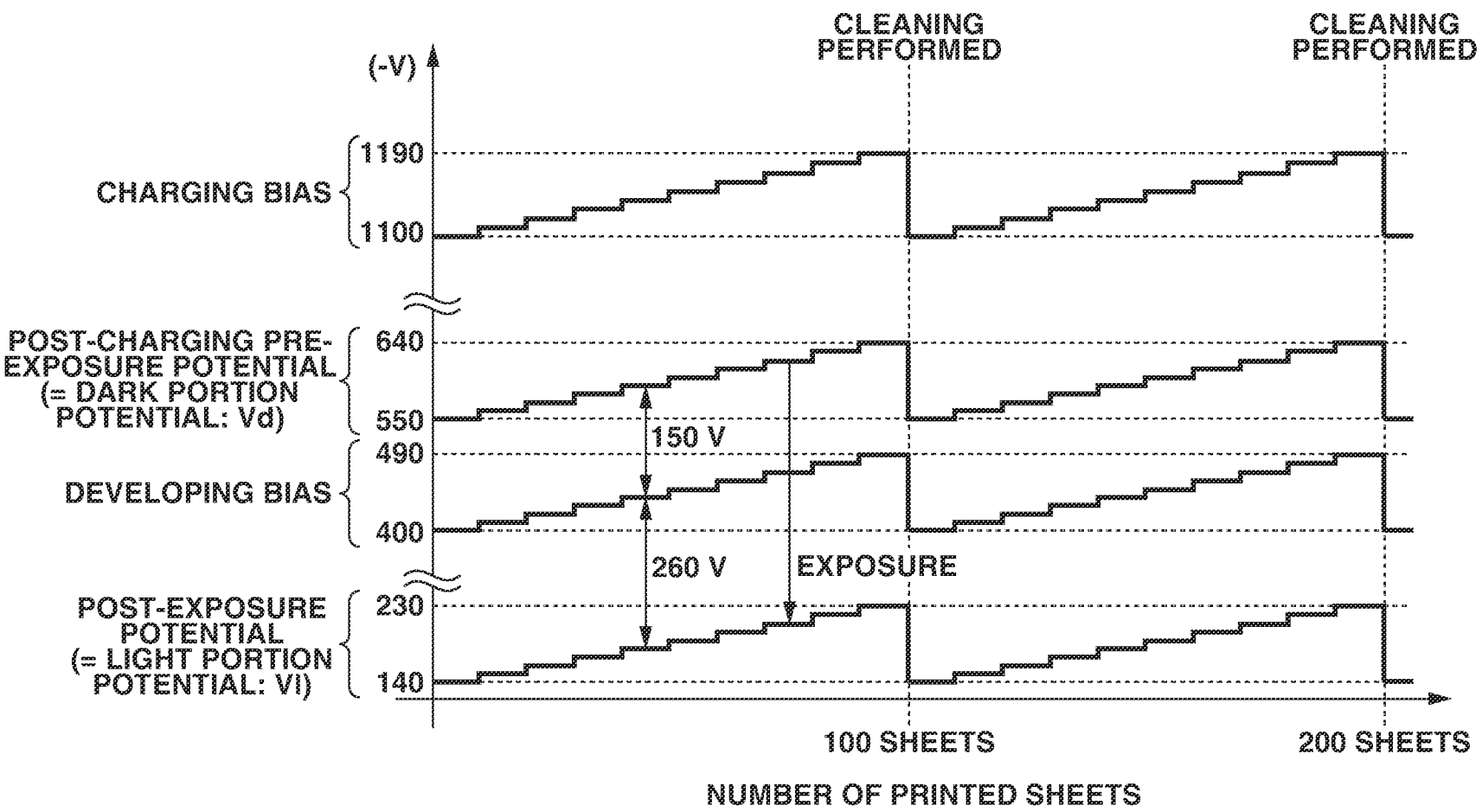
FIG. 8 is a diagram illustrating relationships between biases and electric potentials according to the first exemplary embodiment.

In order to prevent or reduce such a phenomenon, in the first exemplary embodiment, the biases used during continuous printing are adjusted in the following way. The description of the potential is made with reference to FIG. 7 in the order of the rotational direction of the photosensitive drum 1 from the charging roller 2 to the development roller 42. First, when the charging bias is applied to the charging roller 2, a potential is formed on the photosensitive drum 1. The potential formed at this time is referred to as a "post-charging pre-exposure potential". In the first exemplary embodiment, the post-charging pre-exposure potential is able to be expressed by a dark portion potential (Vd), which is not used to develop toner. When exposure is performed on the photosensitive drum 1 with use of the exposure device 3, the dark portion potential (Vd) on the photosensitive drum 1 changes to a light portion potential (V1), which is a post-exposure potential used to develop toner. Changes of biases for every number of printed sheets in the first exemplary embodiment are illustrated in FIG. 8. FIG. 8 illustrates the relationship between the number of printed sheets (100 sheets×2 times of cleaning=200 sheets) on the horizontal axis and the biases on the vertical axis. In the first exemplary embodiment, the charging bias is changed by −10 V for every 10 sheets in the number of printed sheets. In this way, gradually enlarging the absolute value of the charging bias according to the number of printed sheets leads to the potential difference between the photosensitive drum 1 and the charging roller 2 becoming gradually larger. Therefore, since the amount of discharge becomes larger at the later stage of continuous printing, this is effective to maintain the polarity of toner on the charging roller 2 by discharge. Since, if the charging bias is increased, the potential difference from the developing bias also changes, the developing bias is simultaneously changed by every −10 V. In order that enlarging the absolute values of the charging bias and the developing bias in the same way enables keeping the potential difference of about 150 V, the potential difference between the dark portion potential (Vd) of the photosensitive drum 1 and the developing bias is controlled to be unvarying at the contact position between the development roller 42 and the photosensitive drum 1. Therefore, fogging, in which toner is inappropriately developed to a dark portion, does not occur. The developing device only needs to be set as appropriate in such a degree that fogging does not occur. Moreover, the intensity of exposure on an image portion is gradually strengthened by every 0.01 $\mu J/cm^2$ per printing of 10 sheets, so that the light portion potential (V1) is varied by −10 V per printing of 10 sheets. This enables keeping the difference between the light portion potential (V1) and the developing bias constant at 260 V, and thus enables maintaining the image density during continuous printing. Additionally, the transfer bias is used to adjust the amount of transfer residual toner and the amount of retransfer toner, and the surface potential of the photosensitive drum 1 after being subjected to primary transfer is adjusted to about 0 V by the pre-charging exposure device 7.

When a continuous printing operation is performed while the charging bias and the developing bias are gradually enlarged, the charging bias to be applied during printing of the first sheet is set to about −1100 V. As illustrated in FIG. 8, control to increase the charging bias in absolute value for every 10 sheets of the number of printed sheets is performed. For example, the charging bias to be applied during printing of the 100th sheet in continuous printing becomes −1190 V. After continuous printing is ended, the cleaning operation is performed, and, then, the charging bias is returned to −1100 V and the printing operation is resumed. Repeating these operations in continuous printing of 100 sheets was performed 200 times as with the comparative examples 1 and 2. The results are shown in Table 1.

TABLE 1

| Image Evaluation | Color Tone Variation Caused by Color Mixture | Image Defect Caused by Discharge |
|---|---|---|
| Comparative Example 1 | x | ○ |
| Comparative Example 2 | ○ | x |
| First Exemplary Embodiment | ○ | ○ |

While a color tone variation caused by color mixture occurred in the comparative example 1 and an image defect caused by discharge occurred in the comparative example 2, neither occurred and a good-quality image was obtained in the first exemplary embodiment. It can be considered that this is the effect of varying the charging bias according to the number of printed sheets. It can be considered that the color tone variation caused by color mixture was improved because accelerating discharge between the charging roller 2C and the photosensitive drum 1C at the middle stage to the later stage of continuous printing enabled retaining the polarity of yellow toner 90Y of the inversion polarity on the charging roller 2C. Moreover, with regard to an image defect caused by discharge, it can be considered that the image defect did not occur because the entire amount of discharge was able to be restricted by restricting discharge at the initial stage of continuous printing and then gradually increasing discharge for a period at the middle stage to the later stage of continuous printing, in which discharge became required. At the initial stage of continuous printing, since the opportunity for contact between the charging roller 2 and the photosensitive drum 1 is low, the polarity of toner on the charging roller 2 is kept to be the inversion polarity, so that so large discharge is not required. However, at the middle stage to the later stage of continuous printing, the number of times for which the charging roller 2 and the photosensitive drum 1 come into contact with each other increases and the amount of inversion polarity toner on the charging roller 2 increases, so that larger discharge becomes required. Accordingly, performing bias control as indicated in the first exemplary embodiment is effective to prevent or reduce a color tone variation caused by color mixture and an image defect caused by discharge. Thus, appropriately controlling the amount of discharge during continuous printing enabled satisfying both the retention of retransfer toner on the charging roller 2 and the prevention or reduction of an image defect caused by discharge of the photosensitive drum 1.

Controlling the charging bias in the following way enables outputting a good-quality image even in the cleanerless system. In a case where, before the cleaning operation is performed, the printing operation is continuously performed on a plurality of recording materials including a first recording material and a second recording material, which is used for recording after the first recording material is used, the charging bias larger in absolute value is applied in the printing operation for the second recording material than in the printing operation for the first recording material. Then, along with an increase of the number of printed sheets, there appears a section in which discharge is more prompted than discharge between the charging roller 2 and the photosensitive drum 1 at the time of start of the printing operation. As the section in which discharge is more prompted along with an increase of the number of printed sheets, discharge can be prompted with respect to some recording materials in a continuous printing operation for a plurality of recording materials or discharge can be gradually increased in the entire continuous printing operation for a plurality of recording materials as in the first exemplary embodiment. Prompting discharge in this way enables retaining the polarity of toner on the charging roller 2 and, therefore, enables preventing or reducing color mixture. Moreover, increasing the amount of discharge during the continuous printing operation compared to discharge at the initial stage of the printing operation enables restricting discharge as much as possible by enlarging the amount of discharge compared to that at the initial stage and, therefore, enables preventing or reducing an image defect. Conversion of retransfer toner to the normal polarization due to charging is not so actively performed when the number of printed sheets is small because the charge amount of inversion polarity toner on the charging roller 2 is large. On the other hand, at the latter half, in which the charge amount of toner becomes small and the number of printed sheets becomes large, the polarity of toner shifts from the inversion polarity to the normal polarity. Accordingly, it is particularly desirable to restrict the amount of discharge at the first half and gradually increase the amount of discharge as the printing operation advances toward the latter half. In other words, it is desirable to perform control so that the absolute value of the charging bias applied in the printing operation for the first recording material after the cleaning operation is performed becomes smaller than the absolute value of the charging bias applied in the printing operation for a recording material used immediately before the cleaning operation is performed. Then, after the cleaning operation is performed, the charging bias applied in the printing operation performed immediately before the cleaning operation is performed is changed to the charging bias applied in the printing operation performed immediately after the cleaning operation is performed. Since the printing operation is started again in those conditions, it is possible to restrict the amount of discharge at the first half of the printing operation and gradually increase the amount of discharge as the printing operation advances toward the latter half. Moreover, in a case where the printing operation is performed on a plurality of recording materials before execution of the cleaning operation, the absolute value of the charging bias applied during the printing operation is gradually enlarged as the printing operation comes closer to the timing at which to perform the cleaning operation, so that discharge can be gradually accelerated.

As described above, controlling the charging bias enables gradually prompting discharge during the printing operation, effectively preventing or reducing color mixture caused by retransferred toner, and preventing or reducing an image defect caused by the influence of discharge. Accordingly, since it is possible to delay the timing of execution of the cleaning operation during continuous printing as much as the above issues are prevented or reduced, the number of times of cleaning can be reduced and a downtime can also be reduced.

While the change of the charging bias in the first exemplary embodiment is performed in a stepwise manner for every printing of 10 sheets, the threshold value can be changed as appropriate. Besides the number of printed sheets, the threshold value can be the number of rotations of the photosensitive drum 1 or can be the cumulative printing rate. Moreover, while, in the first exemplary embodiment, the charging bias is changed in a monotonically increasing manner, as long as there is a point at which the charging bias increases compared to that at the time of start of the printing operation during continuous printing, in other words, the amount of discharge increases, the amount of discharge can be reduced or be set constant on the way during continuous printing according to the balance between color mixture and discharge.

The same also applies to the timing at which to perform the cleaning operation by interrupt during continuous printing, and, while, in the first exemplary embodiment, the timing is the time at which continuous printing of 100 sheets has been completed, besides the number of printed sheets, the threshold value can be the number of rotations of the photosensitive drum 1 or can be the cumulative value of printing rates.

Moreover, while, in the first exemplary embodiment, the cleaning operation is performed after the end of the printing operation, as long as the printing operation is able to be continued while toner is retained on the charging roller 2, the cleaning operation does not need to be performed even after printing is ended. For example, a case where an interval between jobs are short, electric charges of toner on the charging roller 2 do not decay so much, and toner is able to be directly retained on the charging roller 2 or a case where the printing rate is low and the amount of inversion polarity toner on the charging roller 2 is small can be considered. Here, considering a case where an interval between jobs is long, since no operation is performed in the interval, discharge does not occur, electric charges of toner adhering onto the charging roller 2 decay, and the inversion polarity thereof comes closer to 0. In that condition, even if the charging bias is applied to the charging roller 2 to perform the printing operation again, toner is not able to be sufficiently electrically retained on the charging roller 2, so that toner would move to the photosensitive drum 1. On the other hand, if an interval between jobs are short, even when the printing operation is once ended, since, until then, printing has been performed while discharge is prompted, the toner retaining force of the charging roller 2 does not so decrease. Therefore, printing can be continued while discharge is increased.

Accordingly, performing control in the first exemplary embodiment enables reducing a cleaning operation which is performed after the printing operation or on the way during continuous printing.

Moreover, in the first exemplary embodiment, a case where toner which is charged at the negative polarity is used as a developer has been described. On the other hand, toner which is charged at the positive polarity can be used. In a case where the present disclosure is applied to such a case, while the bias relationship inverts between the positive and negative polarities and the charging bias and the developing bias during printing become at the positive polarity, when the applied biases are viewed in absolute values, the relationship thereof is the same as that in the first exemplary embodiment. Even in such a case, applying the present disclosure enables reducing a cleaning operation which is performed after the printing operation or on the way during continuous printing.

In the above-described first exemplary embodiment, the charging bias is changed during continuous printing so as to prevent or reduce color mixture and an image defect caused by discharge. To solve the above-mentioned issue, discharge between the charging roller 2 and the photosensitive drum 1 only needs to be adjusted. Accordingly, if the charging bias to be applied to the charging roller 2 is changed as in the first exemplary embodiment, the amount of discharge changes. In a second exemplary embodiment, instead of the state of the charging roller 2, the state of the photosensitive drum 1 is changed. Therefore, as a method for changing the surface potential of the photosensitive drum 1, the exposure device 3 is used. The exposure device 3 is configured to perform normal exposure for a printing portion to form, at an image portion, a light portion potential (V1) as a post-exposure potential of the image portion and configured to perform weak exposure on a non-image portion to form a dark portion potential (Vd) as a post-exposure potential of the non-image portion. The photosensitive drum 1 is once charged at a post-charging pre-exposure potential (Vd1), which is higher than or equal to the dark portion potential (Vd), by the charging roller 2 to which the charging bias has been applied. The exposure device 3 (a post-exposure device) located at the position after charging and before developing with respect to the rotational direction of the photosensitive drum 1 is caused to perform weak exposure to expose the surface of the photosensitive drum 1, thus causing the surface potential thereof to decay (decrease). This method uses not only the charging process but also the exposure process, thus being able to obtain a target dark portion potential (Vd). According to this method, the surface potential of the photosensitive drum 1 can be previously lowered. Moreover, in the second exemplary embodiment, exposure by the pre-charging exposure device 7 is not performed, and the transfer bias is used to lower the surface potential of the photosensitive drum 1 after the photosensitive drum 1 passes through the transfer contact portion. With this, the potential difference becomes larger as much as the amount of exposure than the potential difference between the surface potential of the photosensitive drum 1 and the charging roller 2 after primary transfer formed by the charging bias, so that the effect of increasing the amount of discharge can be expected.

Moreover, the usage of this method contributes to stability improvement of electric potential. Since a discharge starting voltage (Vth) of the DC charging method varies depending on the photosensitive layer film thickness of the photosensitive drum 1, if the film thickness of the photosensitive drum 1 decreases due to abrasion of the photosensitive drum 1, the dark portion potential (Vd) would increase. Therefore, since it is necessary to adjust the dark portion potential (Vd) by changing the charging bias to be applied according to the film thickness of the photosensitive drum 1, the amount of discharge would change depending on the film thickness. In other words, if the film thickness of the photosensitive drum 1 changes, it becomes difficult to control the amount of discharge, so that it is difficult to keep the balance of margins of color mixture and an image defect caused by discharge. Accordingly, the film thickness of the photosensitive drum 1 is calculated from information associated with discharge such as the number of printed sheets, the number of rotations of the photosensitive drum 1, the time of application of the charging bias, or the amount of exposure, and the amount of exposure is controlled based on the calculated film thickness, so that the electric potential setting can be made constant and the amount of discharge can be adjusted. According to this method, the ranges of the maximum amount of light for forming the light portion potential (V1) and the minimum amount of light for forming the dark portion potential (Vd) are changed according to the calculated film thickness of the photosensitive drum 1 without depending on the charging bias, so that the image density, the line width, and the gradation property can be stably reproduced.

Therefore, to appropriately prompt discharge during continuous printing, the charging bias and the amount of exposure are controlled for every number of printed sheets. Specifically, as with the first exemplary embodiment, discharge is not so much performed at the initial stage of continuous printing, and, at the middle stage of continuous printing to the latter half thereof, the charging bias and the amount of exposure for prompting discharge are set.

Figure 9:
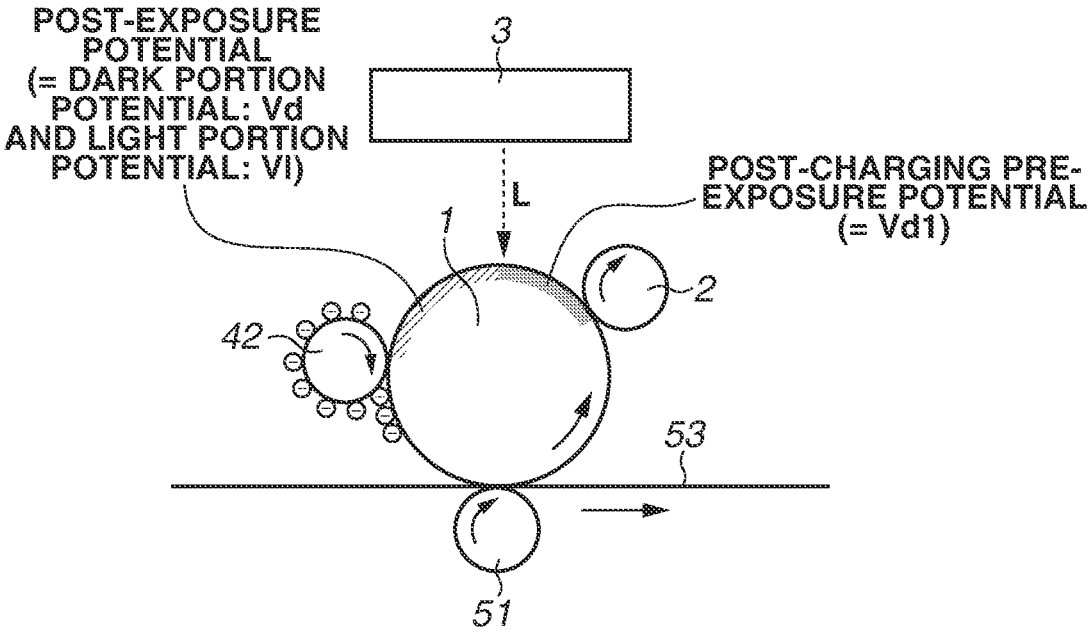
FIG. 9 is a diagram illustrating a positional relationship between electric potentials according to a second exemplary embodiment.
Figure 10:
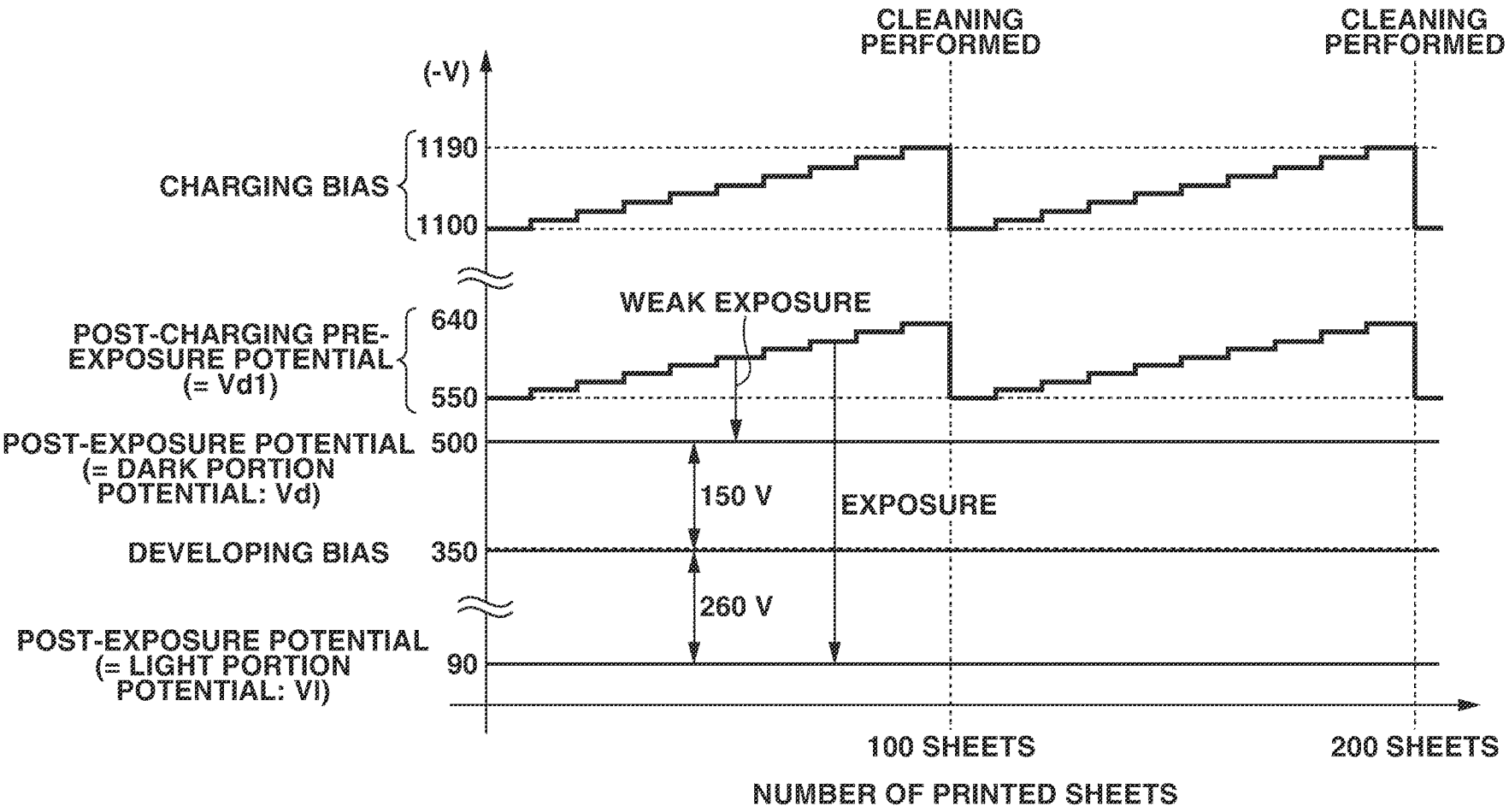
FIG. 10 is a diagram illustrating relationships between biases and electric potentials according to the second exemplary embodiment.

In the second exemplary embodiment, the amount of exposure is adjusted in the following way. The description of the potential is made with reference to FIG. 9 in the order of the rotational direction of the photosensitive drum 1 from the charging roller 2 to the development roller 42. First, when the charging bias is applied to the charging roller 2, a potential is formed on the photosensitive drum 1. The potential formed at this time is referred to as a "post-charging pre-exposure potential (Vd1)". In the second exemplary embodiment, exposure is performed by the exposure device 3 with respect to the post-charging pre-exposure potential (Vd1) to the dark portion potential (Vd), which is not used to develop toner, and the light portion potential (V1), which is used to develop toner. When weak exposure, which is weaker than that in the normal printing, is performed on the photosensitive drum 1, the surface potential of the photosensitive drum 1 changes from the post-charging pre-exposure potential (Vd1) to the dark portion potential (Vd), which is a weak post-exposure potential. On the other hand, when the normal exposure is performed, the surface potential of the photosensitive drum 1 becomes the light portion potential (V1), which is a post-exposure potential used to develop toner. The biases and the amounts of exposure for every number of printed sheets are illustrated in FIG. 10. FIG. 10 illustrates the relationship between the number of printed sheets on the horizontal axis and the biases on the vertical axis, as with FIG. 8.

In the second exemplary embodiment, −1100 V is applied as the charging bias at the time of start of the printing operation. The post-charging pre-exposure potential (Vd1), which is the surface potential of the photosensitive drum 1 immediately after charging at this time, becomes about −550 V. After that, weak exposure is performed with respect to the post-charging pre-exposure potential (Vd1) of the photosensitive drum 1 at the intensity of 0.030 $\mu J/cm^2$. With this, the dark portion potential (Vd), which is a weak post-exposure potential, becomes about −500 V. As the developing bias, −350 V is applied to the development roller 42, and the potential difference from the dark portion potential (Vd) is 150 V as with the first exemplary embodiment. Then, the charging bias is varied by every −10 V per printing of 10 sheets. At this time, the surface potential of the photosensitive drum 1 immediately after charging would also change by every −10 V. Therefore, the intensity of weak exposure on a dark portion is gradually strengthened by every 0.002 $\mu J/cm^2$ per printing of 10 sheets, so that the dark portion potential (Vd) is adjusted as appropriate to be constant at about −500 V. With this, since, while the charging bias rises in absolute value, the dark portion potential (Vd) of the photosensitive drum 1 does not change, as the number of printed sheets increases, the amount of discharge between the charging roller 2 and the photosensitive drum 1 increases. Moreover, since the dark portion potential (Vd) and the potential of the development roller 42 do not change, the potential difference can be kept constant at 150 V, so that fogging does not occur. Similarly, the exposure intensity during printing is strengthened by 0.01 $\mu J/cm^2$ per printing of 10 sheets, so that the light portion potential (V1) can be kept to be about −90 V. This enables keeping the difference between the light portion potential (V1) and the developing bias constant at 260 V and thus enables maintaining the image density during continuous printing.

As the result of the repetition of continuous printing and the cleaning operation in continuous printing of 100 sheets being performed 200 times, in the second exemplary embodiment, neither color mixture nor an image defect caused by discharge occurred as with the first exemplary embodiment. It can be considered that, since increasing the charging bias and the amount of exposure enabled appropriately performing the polarity maintenance of retransfer toner retained on the charging roller 2 and preventing or reducing the entire amount of discharge, both of the prevention or reduction of color mixture and the prevention or reduction of an image defect caused by discharge were satisfied. Performing bias control and exposure control as described in the second exemplary embodiment enabled preventing or reducing a color tone variation caused by color mixture and an image defect caused by discharge.

Accordingly, controlling the charging bias and the amount of exposure in the following way enables outputting a good-quality image even in the cleanerless system. In a case where, before the cleaning operation is performed, the printing operation is continuously performed on a plurality of recording materials including a first recording material and a second recording material, which is used for recording after the first recording material is used, the charging bias larger in absolute value is applied in the printing operation for the second recording material than in the printing operation for the first recording material. Then, in that period, the amount of exposure to be used for exposure on a non-image portion is set larger in the printing operation in which the charging bias relatively large in absolute value is applied than in the printing operation in which the charging bias relatively small in absolute value is applied. Moreover, the potential of a non-image portion of the photosensitive drum 1 is set the same between the case where the printing operation in which the charging bias relatively large in absolute value is applied is performed and the case where the printing operation in which the charging bias relatively small in absolute value is applied is performed. Accordingly, along with an increase of the number of printed sheets, there appears a section in which discharge is more prompted than discharge between the charging roller 2 and the photosensitive drum 1 at the time of start of the printing operation. Therefore, preventing or reducing color mixture caused by retransferred toner and gradually increasing the amount of exposure enable preventing or reducing an image defect caused by the influence of discharge.

For the same reason as that in the first exemplary embodiment, it is particularly desirable to restrict the amount of discharge at the first half and gradually increase the amount of discharge as the printing operation advances toward the latter half. In the second exemplary embodiment, not only the charging bias is controlled as in the first exemplary embodiment, but also exposure is controlled in the following way. The amount of exposure to be used for exposure in the printing operation for the first recording material after execution of the cleaning operation is controlled to be set smaller than the amount of exposure to be used for exposure in the printing operation for a recording material immediately before execution of the cleaning operation. Then, after the cleaning operation is performed, the amount of exposure to be used for exposure on the photosensitive drum 1 by the exposure device 3 at the time of the printing operation immediately before execution of the cleaning operation is changed to the amount of exposure to be used at the time of the printing operation immediately after execution of the cleaning operation. Since the printing operation is started again in those conditions, it is possible to restrict the amount of exposure at the first half of the printing operation and gradually increase the amount of exposure as the printing operation advances toward the latter half. Moreover, in a case where the printing operation is performed on a plurality of recording materials before execution of the cleaning operation, the amount of exposure to be used for exposure at the time of the printing operation is gradually enlarged as the printing operation comes closer to the timing at which to perform the cleaning operation, so that discharge can be gradually accelerated.

While, in the second exemplary embodiment, as illustrated in FIG. 10, the amount of discharge is increased by varying the charging bias and keeping the dark portion potential (Vd), which is a post-exposure potential, constant, the dark portion potential (Vd) can be varied according to a change of the charging bias. Specifically, along with an increase of the absolute value of the charging bias to be applied during the printing operation, the amount of discharge can be gradually increased by performing control so that the amount of exposure becomes large.

As described above, controlling the charging bias and the amount of exposure enables gradually prompting discharge during the printing operation, effectively preventing or reducing color mixture caused by retransferred toner, and preventing or reducing an image defect caused by the influence of discharge. Accordingly, since it is possible to delay the timing of execution of the cleaning operation during continuous printing as much as the above issues are prevented or reduced, the number of times of cleaning can be reduced and a downtime can also be reduced.

Moreover, the second exemplary embodiment needs less restrictions on devices than the first exemplary embodiment. Specifically, since weak exposure is used, the surface of the photosensitive drum 1 can be charged at a predetermined dark portion potential (Vd) without depending on the charging bias and the film thickness of the photosensitive drum 1, so that a method useful for performing the scheme of shared use of a high-voltage power supply can be provided. Therefore, in a case where a high-voltage power supply is shared for a plurality of colors and a plurality of photosensitive drum 1 having respective different film thicknesses is used, the amount of weak exposure and the amount of exposure during the normal printing are adjusted for every station, so that image formation can be performed while the dark portion potential (Vd) and the light portion potential (V1) are maintained.

While, in the second exemplary embodiment, discharge is adjusted by the charging bias and exposure performed after charging without pre-charging exposure being performed, the pre-charging exposure device 7 can be used. Even when the pre-charging exposure device 7 is used, the amount of discharge increases as much as an increase of the charging bias, so that the same function effect as that in the first exemplary embodiment can be obtained and the electric potential also becomes stabilized by exposure performed after charging. Accordingly, the second exemplary embodiment needs less restrictions on devices and uses weak exposure, thus being able to charge the surface of the photosensitive drum 1 at a predetermined dark portion potential (Vd) without depending on the charging bias and the film thickness of the photosensitive drum 1 and being also able to adjust discharge.

In a third exemplary embodiment, in a case where a plurality of process cartridges is included, when a charging bias power supply output for supplying charging biases to be applied to respective charging rollers 2 is fixed, the respective amounts of weak exposure are adjusted with use of the exposure device 3. This enables miniaturization of the apparatus and a reduction in cost.

In that case, varying the electric potential formed with weak exposure for every number of continuously printed sheets enables varying the amount of discharge between the charging roller 2 and the photosensitive drum 1. At this time, as with the second exemplary embodiment, exposure by the pre-charging exposure device 7 is not performed. With this, the surface potential of the photosensitive drum 1 having passed through the transfer contact portion differs depending on the electric potential obtained after weak exposure, and the amount of discharge becomes larger in the lower surface potential obtained after weak exposure. Accordingly, even when the charging bias is fixed, adjusting the amount of weak exposure enables maintaining the polarity of toner retained on the charging roller 2.

Figure 11:
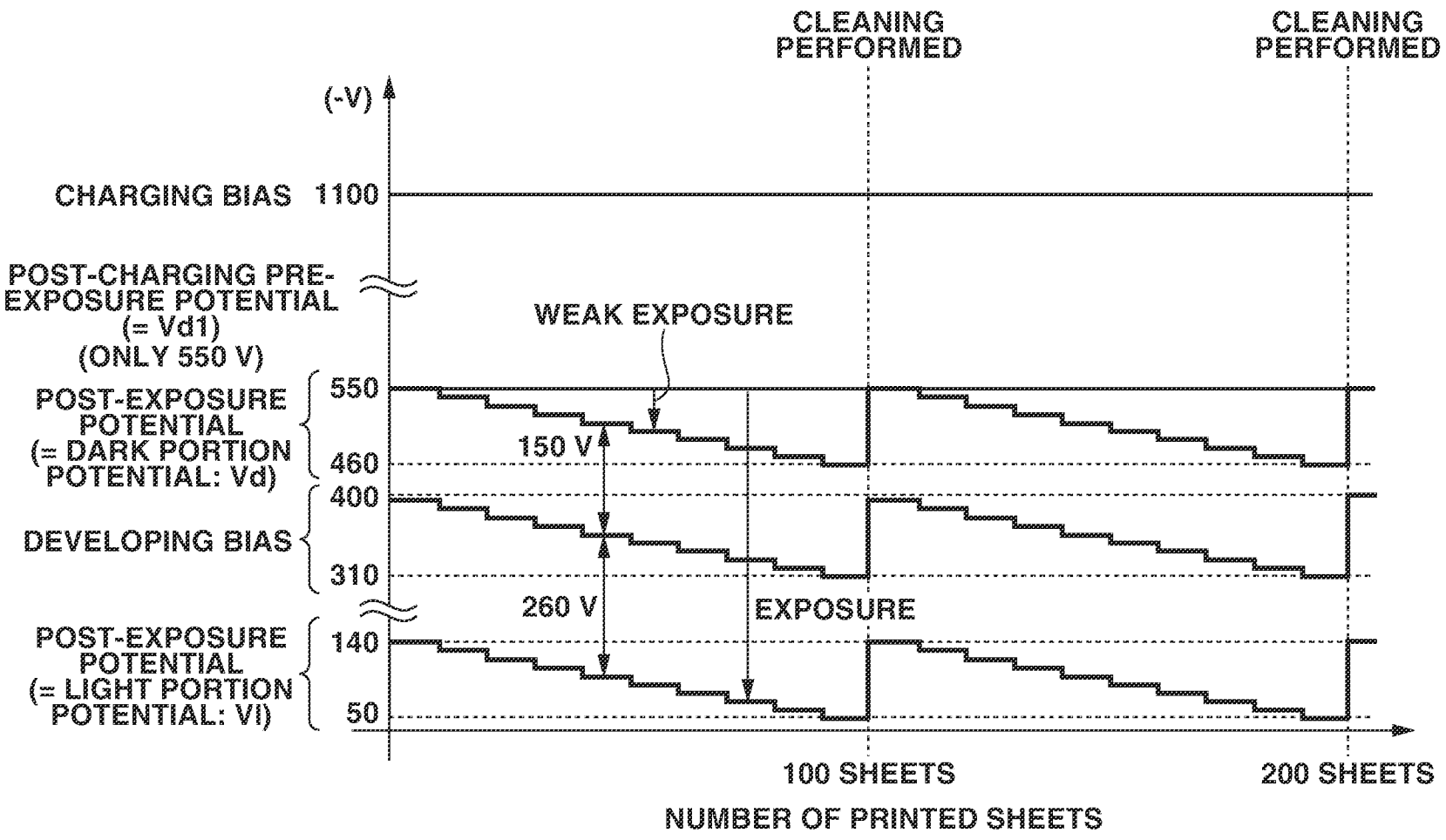
FIG. 11 is a diagram illustrating relationships between biases and electric potentials according to a third exemplary embodiment.

In the third exemplary embodiment, the charging bias during continuous printing is fixed and the amount of exposure is adjusted in the following way. The biases and the amounts of exposure for every number of printed sheets are illustrated in FIG. 11. FIG. 11 illustrates the relationship between the number of printed sheets on the horizontal axis and the biases on the vertical axis, as with FIGS. 8 and 10.

In the third exemplary embodiment, −1100 V is applied as the charging bias at the time of start of the printing operation. At this time, the post-charging pre-exposure potential of the photosensitive drum 1 becomes about −550 V. At the time of start of printing, weak exposure is not performed, and the printing operation is performed with just about −550 V set as the dark portion potential (Vd1=Vd). As the developing bias, −400 V is applied to the development roller 42, and the potential difference from the dark portion potential (Vd) is 150 V. After printing of 10 sheets, weak exposure is performed on a dark portion at the intensity of 0.006 μJ/cm$^2$. With this, while the post-charging pre-exposure potential (Vd1) is about −550 V, the dark portion potential (Vd) is about −540 V. At the same time, the developing bias is varied by every −10 V. This enables keeping the potential difference between the dark portion potential (Vd) and the developing bias constant at 150 V. In the third exemplary embodiment, since the charging bias is set constant, the post-charging pre-exposure potential (Vd1) during continuous printing is constant at −550 V. Strengthening the intensity of weak exposure by every 0.006 μJ/cm$^2$ for every printing of 10 sheets until the 60th sheet varies the dark portion potential (Vd) from −550 V to −500 V. With regard to the 61st sheet and subsequent sheets, strengthening the intensity of weak exposure by every 0.003 μJ/cm$^2$ for every printing of 10 sheets varies the dark portion potential (Vd) by every −10 V.

Moreover, similar to the intensity of weak exposure, strengthening the exposure intensity during normal printing by every 0.01 μJ/cm$^2$ for every printing of 10 sheets varies the light portion potential (V1) from about −140 V for every printing of 10 sheets. This enables keeping the difference between the light portion potential (V1) and the developing bias constant at 260 V and thus maintaining the image density during continuous printing.

When the charging bias is set constant, in a case where, before the cleaning operation is performed, the printing operation is continuously performed on a plurality of recording materials including a first recording material and a second recording material, which is used for recording after the first recording material is used, exposure is performed with the amount of exposure larger in the printing operation for the second recording material than in the printing operation for the first recording material. Then, the dark portion potential (Vd) can be varied in a stable manner With this, even in the third exemplary embodiment, it is possible to adjust the amount of discharge for every number of printed sheets and prevent or reduce color mixture and an image defect caused by discharge. Accordingly, since it is possible to delay the timing of execution of the cleaning operation during continuous printing as much as the above issues are prevented or reduced, the number of times of cleaning can be reduced and a downtime can also be reduced.

Figure 12:
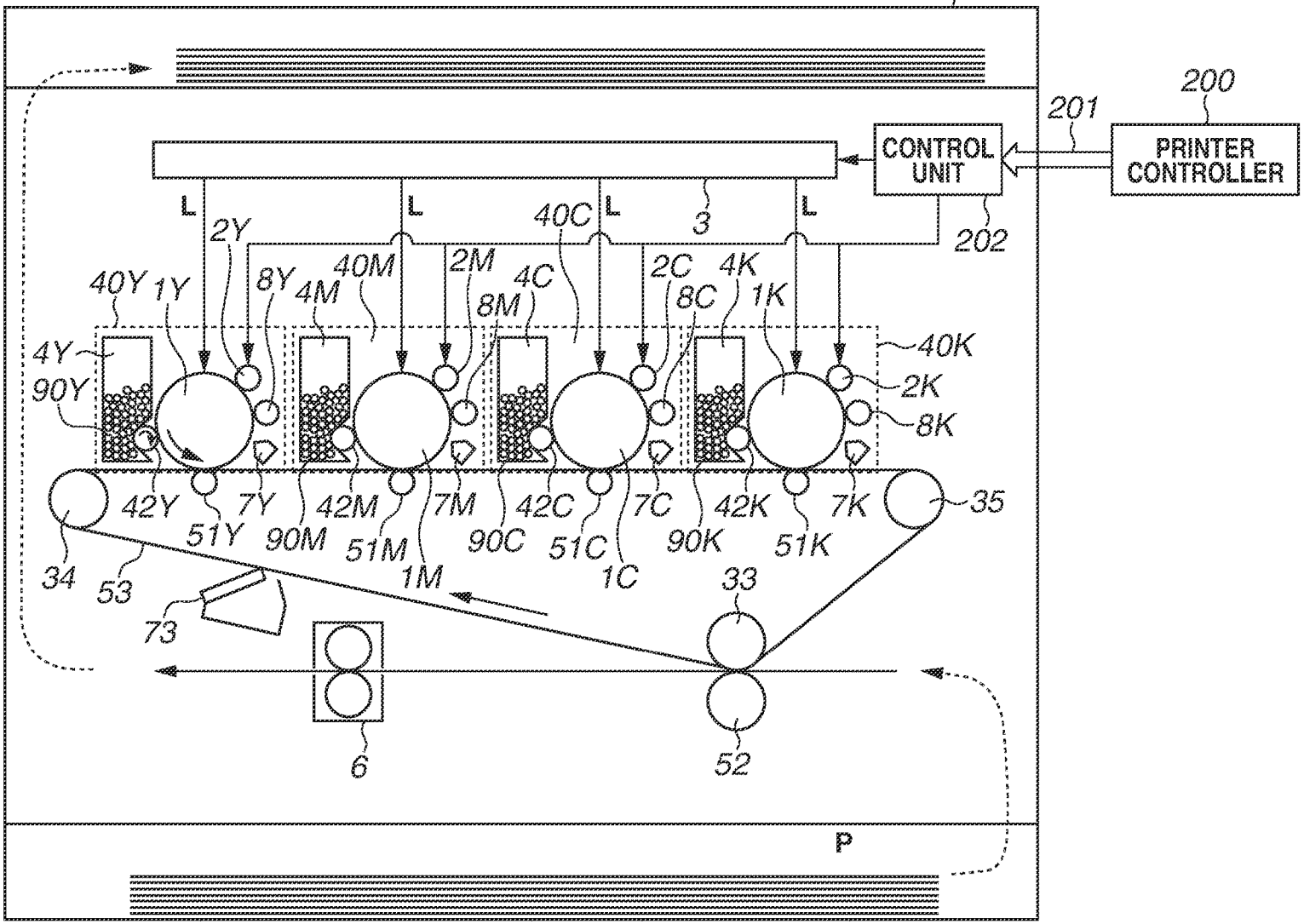
FIG. 12 is a schematic view of an image forming apparatus according to a fourth exemplary embodiment.

In a fourth exemplary embodiment, as illustrated in FIG. 12, a developer recovery roller 8 serving as a developer holding member is located at the downstream side of the pre-charging exposure device 7 and at the upstream side of the contact portion between the charging roller 2 and the photosensitive drum 1 in the rotational direction of the photosensitive drum 1. The developer recovery roller 8 contacts transfer residual toner or retransfer toner before the charging roller 2 to recover retransfer toner, thus not contaminating the charging roller 2. Accordingly, since the functions of image printing and toner recovery can be separately assigned to the charging roller 2 and the developer recovery roller 8, image printing can be performed without bring about charging failure at the charging roller 2 due to adherence of toner. A developer recovery bias application unit (not illustrated) is able to apply a developer holding bias to the developer recovery roller 8. The timing of application of the developer holding bias and the operation at the time of cleaning are similar to those of the charging bias described in the first exemplary embodiment. In a case where, before the cleaning operation is performed, the printing operation is continuously performed on a plurality of recording materials including a first recording material and a second recording material, which is used for recording after the first recording material is used, the holding bias larger in absolute value is applied in the printing operation for the second recording material than in the printing operation for the first recording material. Then, the absolute value of the holding bias to be applied in the printing operation for the first recording material after execution of the cleaning operation is set smaller than the absolute value of the holding bias to be applied in the printing operation for a recording material used immediately before execution of the cleaning operation. Moreover, the absolute value of the holding bias to be applied during the printing operation is gradually enlarged as the printing operation comes closer to the timing at which to perform the cleaning operation, so that discharge can be gradually accelerated. During the cleaning operation, a charging bias in a direction to cause toner transferred from the developer recovery roller 8 to the photosensitive drum 1 to pass through the charging roller 2 is applied to the charging roller 2. With this, the charging roller 2 can be controlled not to have an effect on the cleaning operation. Since any of a positive bias and a negative bias becomes able to be applied to the developer recovery roller 8, the electric potential can be selected according to the polarity of toner.

Accordingly, even in the fourth exemplary embodiment, it is possible to adjust the amount of discharge for every number of printed sheets and prevent or reduce color mixture and an image defect caused by discharge. Since it is possible to delay the timing of execution of the cleaning operation during continuous printing as much as the above issues are prevented or reduced, the number of times of cleaning can be reduced and a downtime can also be reduced.

Moreover, the developer recovery roller 8 only needs to be located in a case where retransfer toner of the inversion polarity electrically adheres to the charging roller 2 and such toner is required to be recovered by the belt cleaning member 73. Accordingly, the developer recovery roller 8 does not need to be located at the process cartridge 40 located at the most upstream side of the intermediate transfer belt 53. While a roller is employed for the developer holding member, the developer holding member is not limited to the roller shape but can be a contact member such as a brush.

Besides, the method for changing the amount of discharge between the charging roller 2 and the photosensitive drum 1 can include adjusting the transfer bias or adjusting the amount of pre-charging exposure under the conditions mentioned in the first to fourth exemplary embodiments. The method can further include controlling the transfer bias in such a manner that the surface potential of the photosensitive drum 1 at the downstream side of the contact portion between the primary transfer roller 51 and the photosensitive drum 1 and at the upstream side of the contact portion between the charging roller 2 and the photosensitive drum 1 in the rotational direction of the photosensitive drum 1 becomes constant. Alternatively, the method can further include controlling the pre-charging exposure device 7 in such a manner that the surface potential of the photosensitive drum 1 at the downstream side of the pre-charging exposure device 7 and at the upstream side of the contact portion between the charging roller 2 and the photosensitive drum 1 in the rotational direction of the photosensitive drum 1 becomes constant. With this, in a case where the charging bias is changed according to continuous printing as with the first exemplary embodiment, the amount of discharge between the charging roller 2 and the photosensitive drum 1 can be varied. Specifically, the transfer bias is set larger in the printing operation in which the charging bias relatively large in absolute value is applied than in the printing operation in which the charging bias relatively small in absolute value is applied, or the amount of pre-charging exposure is set larger, so that the amount of discharge can be gradually increased.

Moreover, instead of varying the charging bias or the amount of exposure as with the first to fourth exemplary embodiments, independently controlling the transfer bias and the amount of pre-charging exposure can also attain a similar effect. In a case where, before the cleaning operation is performed, the printing operation is continuously performed on a plurality of recording materials including a first recording material and a second recording material, which is used for recording after the first recording material is used, the transfer bias larger in absolute value is applied in the printing operation for the second recording material than in the printing operation for the first recording material. Alternatively, exposure is performed with the large amount of pre-charging exposure. With this, since the surface potential of the photosensitive drum 1 between the contact portion between the primary transfer roller 51 and the photosensitive drum 1 and the contact portion between the charging roller 2 and the photosensitive drum 1 can be changed, the amount of discharge between the charging roller 2 and the photosensitive drum 1 can be changed.

Accordingly, since it is possible to appropriately prevent or reduce a color tone variation caused by color mixture and an image defect caused by discharge by controlling the amount of discharge during continuous printing, the number of times of cleaning can be reduced and a downtime can also be reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority of Japanese Patent Application No. 2018-035521, filed Feb. 28, 2018, which is hereby incorporated by reference herein in its entirety.

What is claimed is:

1. An image forming apparatus comprising:

a first image forming unit and a second image forming unit, which is located at a position different from that of the first image forming unit, each including an image bearing member, a charging member configured to perform contact charging on the image bearing member, and a developer bearing member configured to supply toner of normal polarity to the image bearing member so as to form a toner image on the image bearing member;

a charging voltage application unit configured to apply a charging voltage to the charging member; and a control unit configured to control the charging voltage application unit, wherein the control unit performs a printing operation for printing the toner image on a recording material and a cleaning operation for cleaning the charging member at timing different from that of the printing operation and, when performing the printing operation, the control unit controls the charging voltage application unit to apply a charging voltage having a potential to cause toner opposite in polarity to the toner of normal polarity to move from the image bearing member to the charging member, wherein the first image forming unit and the second image forming unit are configured to cause residual toner remaining on a first image bearing member and a second image bearing member which was not used for printing in the printing operation to be respectively recovered by a first developer bearing member and a second developer bearing member, and wherein, before performing the cleaning operation, when successively performing the printing operation on a plurality of recording materials including a first recording material and a second recording material, which is used for printing following the first recording material, the control unit controls the charging voltage application unit to apply the charging voltage larger in absolute value in the printing operation for the second recording material than in the printing operation for the first recording material.

2. The image forming apparatus according to claim 1, wherein the control unit performs control in such a manner that the absolute value of the charging voltage to be applied in the printing operation for an initial recording material used after execution of the cleaning operation is less than the absolute value of the charging voltage to be applied in the printing operation for a recording material used immediately before execution of the cleaning operation.

3. The image forming apparatus according to claim 1, wherein, before performing the cleaning operation, when successively performing the printing operation on a plurality of recording materials, the control unit performs control in such a manner that the absolute value of the charging voltage to be applied during the printing operation is gradually increased as the printing operation comes closer to timing at which to perform the cleaning operation.

4. The image forming apparatus according to claim 1, further comprising:

an exposure unit configured to expose an image portion on a surface of the image bearing member charged by the charging member in the printing operation; and a developing voltage application unit configured to apply a developing voltage to the developer bearing member, wherein the exposure unit also exposes a non-image portion on the surface of the image bearing member, and an amount of exposure on the non-image portion is an amount of exposure in a range in which a post-exposure potential of the non-image portion is not less than the absolute value of the developing voltage to be applied by the developing voltage application unit, and wherein the control unit controls the exposure unit in such a manner that in the printing operation, the higher the absolute value of the charging voltage applied to the charging member becomes, the larger the amount of exposure on the non-image portion becomes.

5. The image forming apparatus according to claim 4, wherein the control unit controls the exposure unit in such a manner that a post-exposure potential of the non-image portion of the image bearing member formed by exposure on the non-image portion becomes the same regardless of the absolute value of the charging voltage in the printing operation.

6. The image forming apparatus according to claim 4, wherein the control unit performs control in such a manner that the amount of exposure used for exposure on the non-image portion in the printing operation for an initial recording material used immediately after execution of the cleaning operation becomes smaller than the amount of exposure used for exposure on the non-image portion in the printing operation for a recording material used immediately before execution of the cleaning operation.

7. The image forming apparatus according to claim 4, wherein, before performing the cleaning operation, when successively performing the printing operation on a plurality of recording materials, the control unit performs control in such a manner that the amount of exposure used for exposure on the non-image portion during the printing operation becomes gradually larger as the printing operation comes closer to timing at which to perform the cleaning operation.

8. The image forming apparatus according to claim 1, wherein the control unit performs control in such a way as to perform the cleaning operation immediately after the printing operation is ended.

9. The image forming apparatus according to claim 1, wherein the control unit performs control in such a manner that the charging voltage to be applied to the charging member by the charging voltage application unit during the printing operation becomes large in absolute value according to one of a number of printed sheets, a number of rotations of the image bearing member, and a cumulative value of printing rates of the toner image formed on the image bearing member during the printing operation, when successively performing the printing operation on a plurality of recording materials.

10. The image forming apparatus according to claim 4, wherein the control unit performs control in such a way as to increase at least one of the absolute value of the charging voltage to be applied to the charging member by the charging voltage application unit during the printing operation and the amount of exposure used for exposure on the non-image portion of the image bearing member according to one of a number of printed sheets, a number of rotations of the image bearing member, and a cumulative value of printing rates of the toner image formed on the image bearing member during the printing operation, when successively performing the printing operation on a plurality of recording materials.

11. The image forming apparatus according to claim 1, wherein the control unit performs the cleaning operation when one of a number of printed sheets, a number of rotations of the image bearing member, and a cumulative value of printing rates of the toner image formed on the image bearing member during the printing operation has reached a predetermined amount, when successively performing the printing operation on a plurality of recording materials.

12. The image forming apparatus according to claim 1, further comprising:

a transfer member configured to transfer the toner image developed on a surface of the image bearing member of the image forming unit to a recording material; and a transfer voltage application unit configured to apply a transfer voltage to the transfer member, wherein the control unit controls the transfer voltage application unit in such a manner that in the printing operation, the higher the absolute value of the charging voltage applied to the charging member becomes, the larger the transfer voltage becomes.

13. The image forming apparatus according to claim 1, further comprising:

an intermediate transfer member configured to bear the toner image of a plurality of colors on a surface thereof by a first toner image formed on the first image bearing member of the first image forming unit and a second toner image formed on the second image bearing member of the second image forming unit being sequentially transferred thereto; and a cleaning member configured to recover the toner image transferred onto the intermediate transfer member, wherein the control unit performs control in such a way as to transfer the toner image moved onto the image bearing member by the cleaning operation onto the intermediate transfer member and to cause the cleaning member to recover the toner image.

14. The image forming apparatus according to claim 13, wherein, in a case where the second image forming unit is located at a downstream side of the first image forming unit and the first image forming unit is located at the most upstream side in a rotational direction of the intermediate transfer member, the control unit performs control in such a way as not to perform the cleaning operation.

15. The image forming apparatus according to claim 13, wherein each of the first image forming unit and the second image forming unit includes a second exposure unit configured to expose each of the first image bearing member and the second image bearing member, the second exposure unit being located at a downstream side of a contact portion between the intermediate transfer member and each of the first image bearing member and the second image bearing member and at an upstream side of each of contact portions between a first charging member and the first image bearing member of the first image forming unit and between a second charging member and the second image bearing member of the second image forming unit, wherein, while the printing operation is performed by the control unit, exposure for evening an electric potential of a surface of each of the first image bearing member and the second image bearing member after the toner image is transferred to the intermediate transfer member is performed by the second exposure unit, and wherein the control unit performs control in such a manner that in the printing operation, the higher the absolute value of the charging voltage applied to the charging member becomes, the larger an amount of exposure used for exposure by the second exposure unit becomes.

16. An image forming apparatus comprising:

a first image forming unit and a second image forming unit, which is located at a position different from that of the first image forming unit, each including an image bearing member, a charging member configured to charge the image bearing member, a developer bearing member configured to supply toner of normal polarity to the image bearing member so as to form a toner image on the image bearing member, and a holding member configured to hold residual toner remaining on the image bearing member which was not used for printing;

a holding voltage application unit configured to apply a holding voltage to the holding member; and a control unit configured to control the holding voltage application unit, wherein the control unit performs a printing operation for printing the toner image on a recording material and a cleaning operation for cleaning the holding member at timing different from that of the printing operation and, when performing the printing operation, the control unit controls the holding voltage application unit to apply a holding voltage having a potential to cause toner opposite in polarity to the toner of normal polarity to move from the image bearing member to the holding member, wherein the first image forming unit and the second image forming unit are configured to cause residual toner remaining on a first image bearing member and a second image bearing member which was not used for printing in the printing operation to be respectively recovered by a first developer bearing member and a second developer bearing member, and wherein, before performing the cleaning operation, when successively performing the printing operation on a plurality of recording materials including a first recording material and a second recording material, which is used for printing following the first recording material, the control unit controls the holding voltage application unit to apply the holding voltage larger in absolute value in the printing operation for the second recording material than in the printing operation for the first recording material.

17. The image forming apparatus according to claim 16, wherein the control unit performs control in such a manner that the absolute value of the holding voltage to be applied in the printing operation for an initial recording material used after execution of the cleaning operation becomes smaller than the absolute value of the holding voltage to be applied in the printing operation for a recording material used immediately before execution of the cleaning operation.

18. The image forming apparatus according to claim 16, wherein, before performing the cleaning operation, when successively performing the printing operation on a plurality of recording materials, the control unit performs control in such a manner that the absolute value of the holding voltage to be applied during the printing operation becomes gradually larger as the printing operation comes closer to timing at which to perform the cleaning operation.

19. The image forming apparatus according to claim 1, wherein the toner is a one-component developer.

20. An image forming apparatus comprising:

a first image forming unit and a second image forming unit, which is located at a position different from that of the first image forming unit, each including an image bearing member, a charging member configured to form a charging portion in contact with the image bearing member and charge a surface of the image bearing member, and a developer bearing member configured to supply toner of normal polarity to the image bearing member so as to form a toner image on the image bearing member;

a potential difference forming unit configured to form a potential difference between a surface potential of the charging member and a surface potential of the image bearing member; and a control unit configured to control the potential difference forming unit, wherein the control unit performs a printing operation for printing the toner image on a recording material and a cleaning operation for cleaning the charging member at timing different from that of the printing operation and, when performing the printing operation, the control unit controls the potential difference forming unit to form the potential difference having a direction to cause toner opposite in polarity to the toner of normal polarity to move from the image bearing member to the charging member, wherein the first image forming unit and the second image forming unit are configured to cause residual toner remaining on a first image bearing member and a second image bearing member which was not used for printing in the printing operation to be respectively recovered by a first developer bearing member and a second developer bearing member, and wherein, before performing the cleaning operation, when successively performing the printing operation on a plurality of recording materials including a first recording material and a second recording material, which is used for printing following the first recording material, the control unit controls the potential difference forming unit in such a manner that the potential difference immediately in front of an entrance of the charging portion becomes larger in the printing operation for the second recording material than in the printing operation for the first recording material.

* * * * *